US009157674B2

(12) United States Patent
Collins et al.

(10) Patent No.: US 9,157,674 B2
(45) Date of Patent: Oct. 13, 2015

(54) CABINET REFRIGERATING SYSTEM

(75) Inventors: Martin Collins, Rockford, MI (US); Jack Bailey, Roseau, MI (US); József Nagy, Budapest (HU); Dan Joslin, Lynn Haven, FL (US)

(73) Assignee: ELECTROLUX HOME PRODUCTS CORPORATION N.V., Zaventem (BE)

( * ) Notice: Subject to any disclaimer, the term of this patent is extended or adjusted under 35 U.S.C. 154(b) by 2434 days.

(21) Appl. No.: 10/562,750

(22) PCT Filed: Jul. 1, 2004
(Under 37 CFR 1.47)

(86) PCT No.: PCT/IB2004/002436
§ 371 (c)(1),
(2), (4) Date: Feb. 3, 2009

(87) PCT Pub. No.: WO2005/003658
PCT Pub. Date: Jan. 13, 2005

(65) Prior Publication Data

US 2009/0205356 A1 Aug. 20, 2009

(30) Foreign Application Priority Data

Jul. 4, 2003 (SE) ..... 0302000-5
Jul. 4, 2003 (SE) ..... 0302003-9

(51) Int. Cl.
*F25D 11/02* (2006.01)
*F25D 23/02* (2006.01)
(Continued)

(52) U.S. Cl.
CPC ..... *F25D 17/062* (2013.01); *F25D 17/067* (2013.01); *F25D 23/026* (2013.01);
(Continued)

(58) Field of Classification Search
CPC ... F25D 17/067; F25D 23/026; F25D 17/062; F25D 2400/10; F25D 21/08; F25D 21/14; F25D 2303/0822; F25D 2303/08222; F25C 1/24
USPC ..... 62/406–407, 449, 415, 418, 419, 426, 62/441
See application file for complete search history.

(56) References Cited

U.S. PATENT DOCUMENTS 4,840,037 A 6/1989 Yamada et al.
4,972,682 A * 11/1990 Smith et al. ..... 62/405
(Continued)

FOREIGN PATENT DOCUMENTS

| | | |
|---|---|---|
| DE | 195 42 978 | 5/1997 |
| EP | 0 374 021 | 6/1990 |
| EP | 0 881 441 | 12/1998 |
| FR | 2 205 653 | 5/1974 |
| FR | 2 583 859 | 12/1986 |

*Primary Examiner* — Mohammad M Ali
(74) *Attorney, Agent, or Firm* — Pearne & Gordon LLP

(57) ABSTRACT

The present invention relates to a refrigerated air supply system (21) for a freezer and/or refrigerator cabinet having at least one cabinet compartment (17) at least partly defined by inner walls (16), an insulation layer at least partly enclosing the cabinet compartment. The cabinet compartment (17) has an compartment opening facing substantially upwards, which compartment opening connects the cabinet compartment (17) with the space surrounding the cabinet, the cabinet also including, a door which in one position covers the compartment opening and substantially encloses the cabinet compartment (17). The cabinet further includes a machine compartment (23) for storing at least a compressor, at least one of the inner walls (16) having a substantially horizontal shelf plane (52) where at least one of the planes (52) is being positioned vertically above the machine compartment (23).

18 Claims, 36 Drawing Sheets

(51) Int. Cl.

| | |
|---|---|
| ***F25D 17/06*** | (2006.01) |
| *F25C 1/24* | (2006.01) |
| *F25D 21/08* | (2006.01) |
| *F25D 21/14* | (2006.01) |

(52) U.S. Cl.

CPC ..... *F25C 1/24* (2013.01); *F25D 21/08* (2013.01); *F25D 21/14* (2013.01); *F25D 2303/0822* (2013.01); *F25D 2303/08222* (2013.01); *F25D 2317/062* (2013.01); *F25D 2317/067* (2013.01); *F25D 2317/0651* (2013.01); *F25D 2317/0664* (2013.01); *F25D 2317/0665* (2013.01); *F25D 2317/0672* (2013.01); *F25D 2400/10* (2013.01)

(56) References Cited

U.S. PATENT DOCUMENTS

| | | | | | |
|---|---|---|---|---|---|
| 5,664,437 | A | * | 9/1997 | Park et al. | 62/407 |
| 5,826,437 | A | | 10/1998 | Kim | |
| 5,996,370 | A | * | 12/1999 | Lee | 62/407 |
| 6,014,868 | A | * | 1/2000 | Hirosawa et al. | 62/407 |
| 6,164,085 | A | * | 12/2000 | Clarke et al. | 62/408 |
| 6,240,739 | B1 | | 6/2001 | Hayes | |
| 6,543,249 | B2 | * | 4/2003 | Kim et al. | 62/407 |
| 7,356,875 | B2 | * | 4/2008 | Abdallah et al. | 15/345 |
| 2002/0162347 | A1 | * | 11/2002 | Walker et al. | 62/256 |
| 2004/0168458 | A1 | * | 9/2004 | Sung | 62/258 |

* cited by examiner

CABINET REFRIGERATING SYSTEM

TECHNICAL FIELD

The present invention relates to a refrigerated air supply system for a freezer and/or refrigerator cabinet having at least one cabinet compartment at least partly defined by inner walls, an insulation layer at least partly enclosing said cabinet compartment. Said cabinet compartment has an compartment opening facing substantially upwards, which compartment opening connects said cabinet compartment with the space surrounding said cabinet, said cabinet also comprising a door which in one position covers said compartment opening and substantially closes said cabinet compartment. The cabinet further comprises a machine compartment for storing at least one compressor, at least one of said inner walls having a substantially horizontal shelf plane where at least one of the planes is being positioned vertically above said machine compartment.

BACKGROUND

Generally Chest freezers have a freezer compartment defined by an inner case surrounded by insulation which is cased by an outer case. The cooling system is normally static with a cooling circuit comprising a condenser, a compressor and an evaporator providing cooling energy to the compartment. In static systems the evaporator has a large surface in direct or indirect contact with the chest freezer compartment. Direct contact means that the evaporator is positioned on the inner case inside the compartment, with cooling agent tubes providing agent to the evaporator from the closed cooling system.

Indirect contact is normally used in Chest freezers. In such freezers the evaporator consist in a meandering tube extending between the inner and outer case. In order to achieve a good heat transfer between the evaporator and the compartment, the inner case in normally made in a metal, such as aluminum. The evaporator tube is then placed in contact with the inner case in order to transfer cooling energy from said tube to said case. The cooling energy is further transferred from the inner case to the compartment. Normally the evaporator is placed in contact with the inner casing at its floor side and all four sidewalls.

The Chest freezer compartment is normally enclosed by a door or lid enclosing the compartment opening facing vertically upwards. The door is normally hinged in the outer casing and has a gasket enabling for an air tight closing of the compartment. The hinges are designed to hold the door in an open position when needed. Alternately, the door is held in this position by other means. Moreover, lights means are normally mounted on the lid or the inner case and activated when the door is opened. The light means enables for the user to see down into the compartment. Chest freezer also has baskets hanged resting on the upper horizontal side of the inner and outer cases. These baskets are detachable and can be moved along said upper side.

In order to provide the right amount of cooling air to the compartment a control system is used. This system contains means to receive measured data of temperature, cooling system conditions and operation values adjusted by the user. Using these, the system operates the compressor and cooling system valves in such a way to achieve the best operational conditions. The compressor is then operated so that the cooling agent provides the right amount of cooling energy to the compartment in order to achieve a proper freezer temperature.

One major problem with these kinds of static cooling systems is that the static chest freezer systems tend to create a lot of frost ice on the compartment wall sides. Moreover, the static chest freezer systems are not very good at achieving an even temperature throughout the whole compartment. Another problem is that the heat transfer is not very efficient from the evaporator tubes to the compartment meaning that more energy is needed in order to provide a proper freezer temperature. A further problem is that the arrangement of the evaporator often causes problems during manufacture and use since the tube has to be in direct contact with the inner metal case.

EPO patent publication EP0881441A shows a system for providing cooling energy into freezer and refrigerator compartments. The cooling system is of a dynamic kind and has a fan unit which provides cooling energy throughout the compartments. The refrigerated air is generated by the evaporator and circulated by a fan that drives air through said evaporator. Portions of said air is guided into different direction in order to provide refrigerated air into different parts of the cabinet.

The above-mentioned dynamic cooling system is designed for a refrigerator and freezer compartment. Dynamic systems likes this are commonly used especially for cooling standing cabinets. Ducts of different kinds and baffles are then used in order to guide the air in a proper way. There are different patent applications that suggest ways of implementing dynamic cooling systems into cabinets.

The dynamic systems have a lot of benefits in order to solve the above-mentioned problems. Since the air is circulated around the cabinet, the moisturized and heated air is removed from the cabinet, which avoids frost ice to be collected on the compartment walls and floor. Moreover; the cooling system can be compacted, making it easier and cheaper to implement and produce. Another benefit is that the heat transfer works much better since flowing air gets in direct connect with the foodstuff stored in the compartment.

It is an object of the present invention to provide a cooling system for a Chest freezer which enables a frost-free compartment and also improves the heat transfer between the cooling system and the foodstuff. Moreover, it is an object of the present invention to provide a cooling system for a chest freezer which is easy to implement into an ordinary chest freezer compartment for production.

SUMMARY OF THE PRESENT INVENTION

The present invention relates to a refrigerated air supply system for a freezer and/or refrigerator cabinet having at least one cabinet compartment at least partly defined by inner walls, an insulation layer at least partly enclosing said cabinet compartment. Said cabinet compartment has an compartment opening facing substantially upwards, which compartment opening connects said cabinet compartment with the space surrounding said cabinet, said cabinet also comprising a door which in one position covers said compartment opening and substantially closes said cabinet compartment. The cabinet further comprises a machine compartment for storing at least one compressor, at least one of said inner walls having a substantially horizontal shelf plane where at least one of the planes is being positioned vertically above said machine compartment. The refrigerated air supply system of the present invention is positioned inside at least one of said cabinet compartments, the system comprising at least one evaporator, at least one return ducting part and at least one fan. Said refrigerated air supply system further comprises at least one air supply outlet which provides an airflow into at least one of said cabinet compartments and at least one air supply inlet which brings an airflow out from at least one of said cabinet compartments.

BRIEF DESCRIPTION OF THE DRAWINGS

The invention will be described in form of illustrative embodiments by making reference to the accompanying drawings, in which FIGS. 1-12 relate to a first embodiment of the invention, FIGS. 13-32 relate to a second embodiment of the invention whereas FIGS. 33-36 relate to a modified lid to the arrangement described in FIGS. 13-32.

DESCRIPTION OF ILLUSTRATIVE EMBODIMENTS

Figure 1:
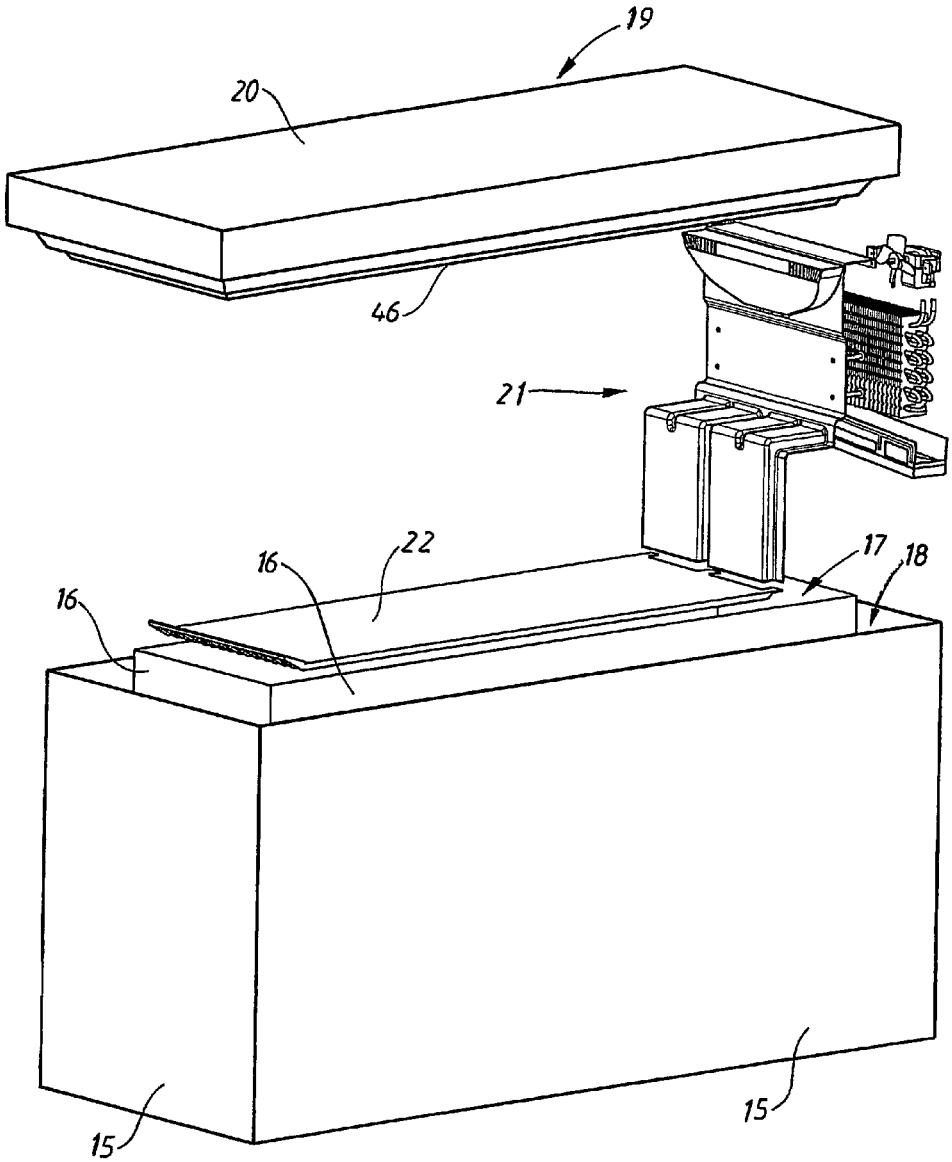
FIG. 1 shows an exploded perspective view of the refrigerated air supply system according to the present invention positioned inside a cabinet.

A first illustrative embodiment of the present invention will now be described in relation to the accompanied FIGS. 1-12. FIG. 1 shows a chest freezer cabinet in which a refrigerated air supply system is implemented. The cabinet contains outer walls 15 defining the outer dimensions of said cabinet. These walls are normally made in metal. Moreover, the cabinet also comprises inner walls 16 defining the outer dimensions of the chest freezer compartment 17. In the space 18 between the outer and inner walls an insulation layer is formed, said layer enclosing the floor and side inner walls. The inner walls 16 may for instance be designed with grooves (not shown) that extend in certain directions along its surface. By doing that an airflow will always be able to pass upward or downward in the figure along the inner wall 16. If the inner wall 16 only is flat, there is a risk that some food products will block the airflow along the walls. The grooves will make the blocking almost impossible.

The cabinet also comprises a door or lid 19, from now on named door, which in its closed, horizontal position contributes to enclose said freezer compartment 17. The door is preferably hanged by hinges (not shown) which guides said door between its open and closed position. Moreover, gaskets are used (not shown) which contributes to achieve an airtight sealing of the compartment. The door also has an outer wall 20 and an inner wall 46 between which insulation is placed. Together, with the rest of the cabinet the compartment is thereby sufficiently insulated to keep its freezing temperature. The inner wall may also for instance be designed with grooves that extend in certain directions along its surface. By doing that an airflow will always be able to pass from the right to left in the figure along the inner wall 46. If the inner wall 46 only is flat, there is a risk that some food products will block the airflow along the walls. The grooves will make the blocking almost impossible.

FIG. 1 also shows important parts of the cooling system, which system defines the scope of the present invention. The important parts are the refrigerated air supply system 21 and the floor ducting part 22. The system will be described more in details in relation to FIG. 2-7 and the part in relation to FIG. 8-11. The system is in the illustrative embodiment positioned inside the space enclosed by the outer walls 15.

Figure 12:
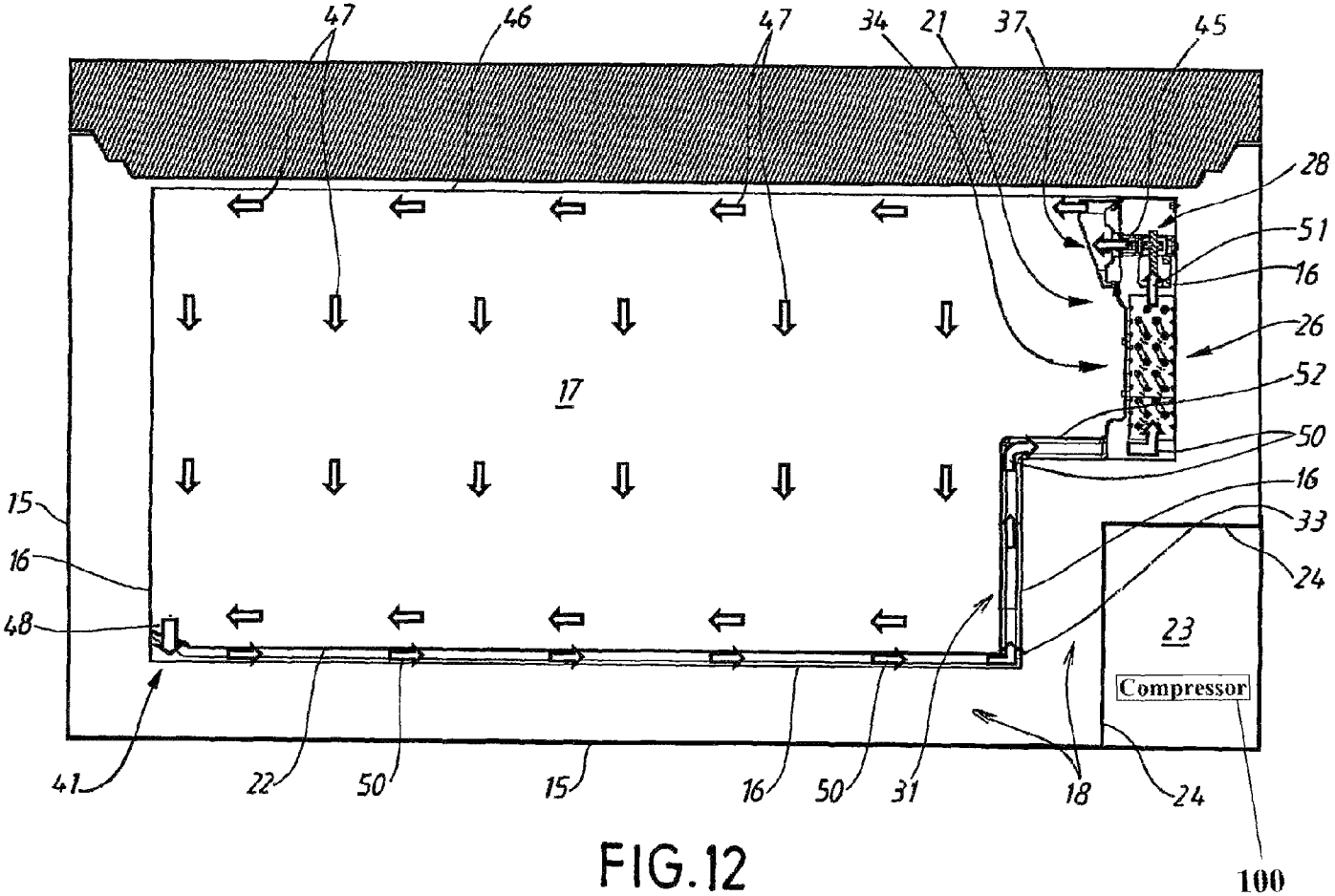
FIG. 12 shows a cross sectional view of the cabinet according to FIG. 1

The cabinet also comprises a machine compartment 23, see FIG. 12, positioned in the lowest right part of the cabinet shown in FIG. 1. In this compartment the compressor 100 and means (not shown) for frost water drainage are positioned. The compartment preferably has an opening (not shown)

facing the area surrounding said cabinet in order for heat from the compressor to be removed efficiently. The machine compartment does not have any opening facing the freezer compartment 17. The means for frost water drainage could for instance comprise a heated tray (not shown) on which the frost water is vaporized. The heating energy from the compressor enables this. Other solutions for frost water drainage are of course possible. The frost water originates from the refrigerated air supply system 21 described further below, and is drained from the refrigerated air supply system to the machine compartment through at least one drainage pipe connecting the system with the heated tray or else.

Moreover, pipes connect the refrigerated air supply system 21 with the compressor in order for the refrigerant to circulate and transport the heat energy collected at the evaporator. Other parts, such as a control system (not shown) and sensors (not shown) do also communicate with each other, the refrigerated air supply system and the compressor. The pipes together with the compressor, the water drainage means, the refrigerated air supply system and the control system with sensors together forms the cooling system operating said chest freezer.

The volume occupied by the machine compartment 23 results in that the freezer compartment 17 loses some of its volume. Inside the compartment the inner walls 16 will therefore form a shelf plane 52. This is shown in FIG. 12. In common wording the machine compartment is called the "doghouse". In FIG. 12, showing a cross sectional side view of the cabinet, the machine house is numbered 23. The figure shows that a Chest freezer cabinet, which despite the inner walls 16, has the outer walls 15.

In FIG. 12 a machine compartment walls 24 defines the compartment 23. The machine compartment walls separate the freezer compartment 17 from the compressor and insulation is also placed in the space between the inner walls 16 and the machine compartment walls 24 to avoid compressor heat to reach the freezer compartment. Moreover, the outer wall 15 also surrounds the machine compartment except for at least one opening ventilating compressor heat from the machine compartment. This kind of solution is very common in chest freezers today. The machine compartment wall is designed to allow for pipes to connect the freezer compartment with the machine compartment.

Figure 2:
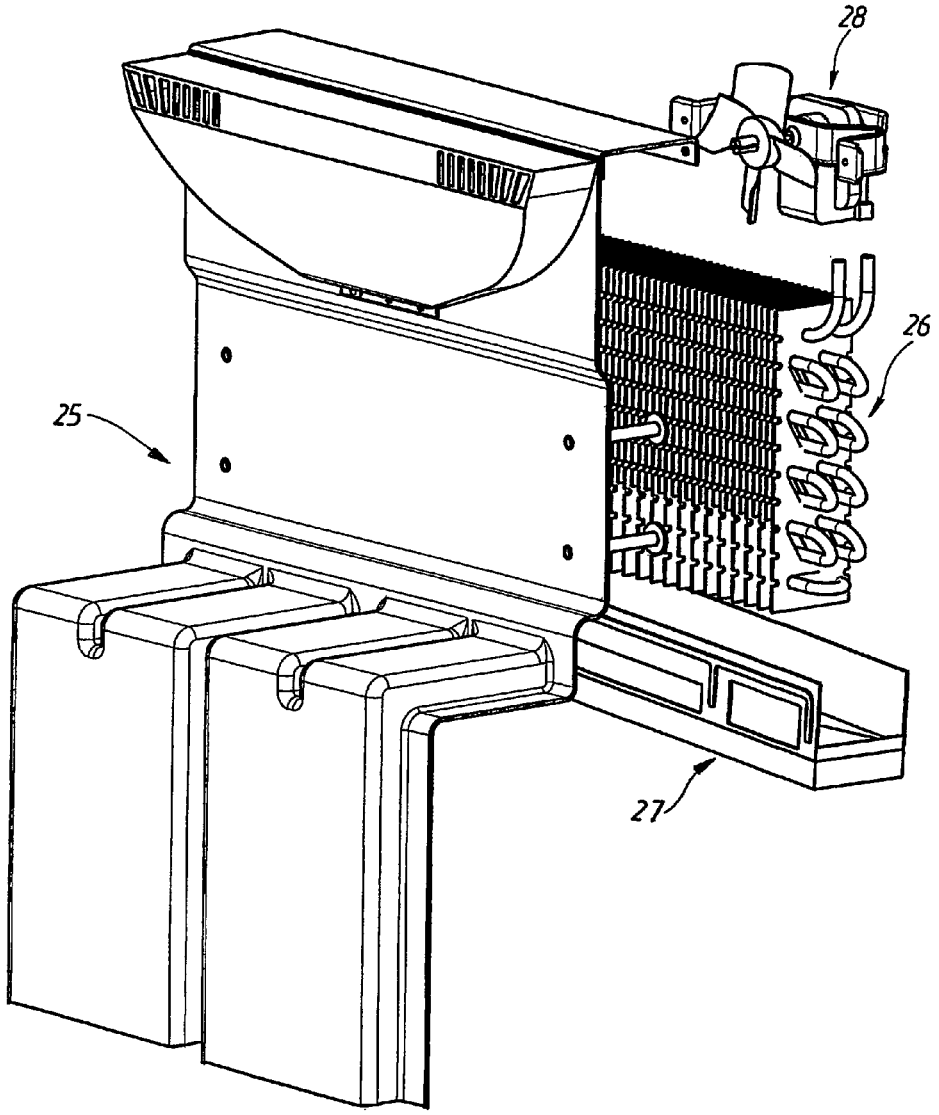
FIG. 2 shows an exploded perspective view of the sole refrigerated air supply system according to FIG. 1.
Figure 3:
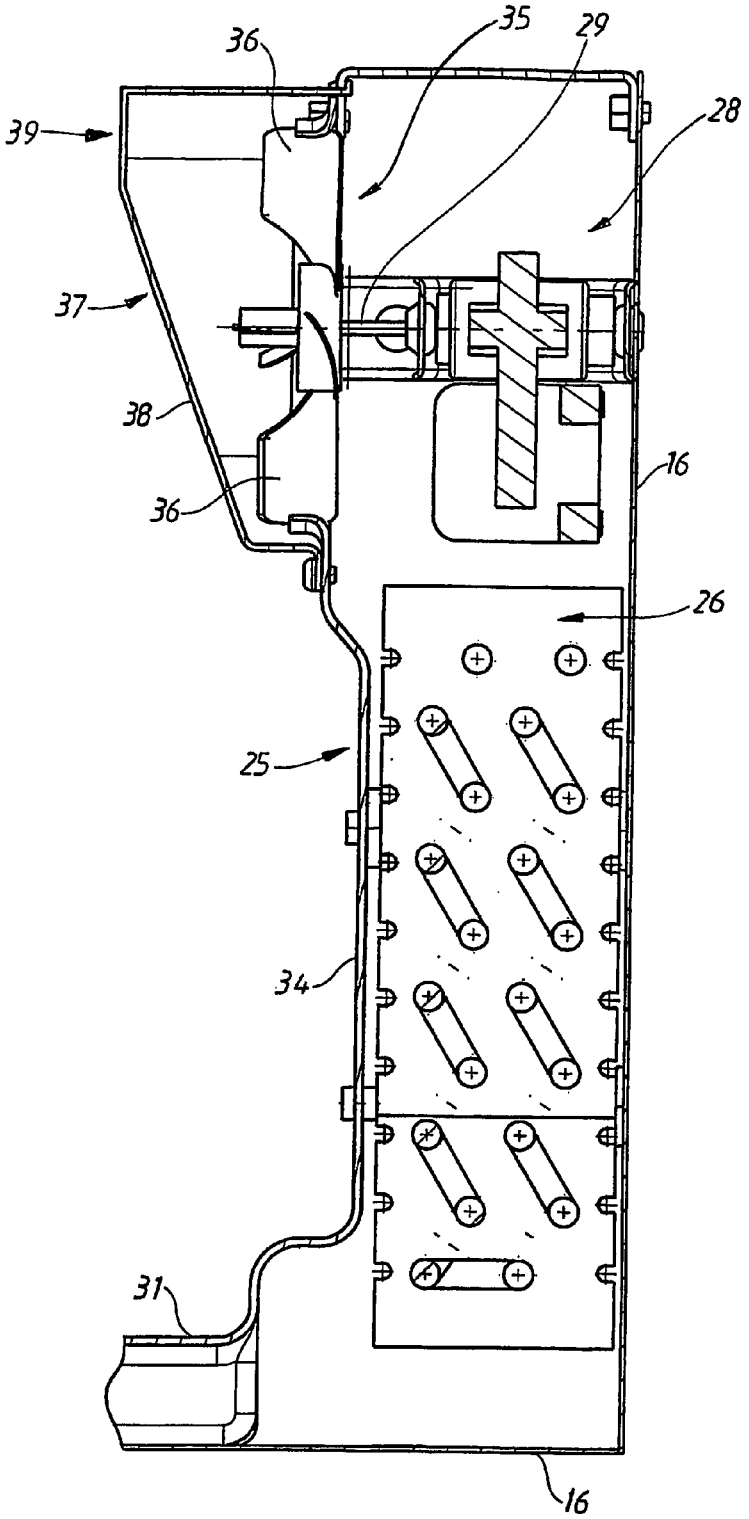
FIG. 3 shows a side view of the refrigerated air supply system according to FIG. 2.

FIG. 2 shows a perspective view of the refrigerated air supply system 21 and FIG. 3 shows a side view of the same system. The system according to the illustrative embodiment is as shown in FIGS. 1 and 12 positioned inside the freezer compartment 17. In FIG. 12 it can be seen how the refrigerated air supply system is designed to fit with the compartment shape formed by the machine compartment. It should be understood by a person skilled in the art that the refrigerated air supply system may also be placed in a special compartment separated from the freezer compartment, meaning that walls divides the freezer compartment into a space inside which the system is positioned and a space forming the actual freezer compartment. Both spaces are then inside the volume enclosed by the insulation.

The refrigerated air supply systems main parts 21 are a return ducting part 25, an evaporator 26, a frost water-collecting tray 27 and a motor and fan 28. The evaporator is a common type with fins and tubes forming its design. The fins enable for a large contact surface with the surrounding air. The evaporator is further designed and positioned so that air can easily flow through it in a substantially vertical direction. The evaporator is connected to the compressor through pipes extending between the freezer compartment and the machine compartment. As illustrated in FIG. 1-3 and 12, the evaporator in the illustrative embodiment is positioned between the return ducting part 25 and the inner wall 16. A frost-free system compromising heat cables (not shown) is adapted to the refrigerated air supply system. The heat cables is placed on the fins and switched on regularly in order to melt and thereby remove frost ice collected on the evaporator. The frost ice is generated by the moisturized air flowing from the freezer compartment 17 and through the evaporator.

The water-collecting tray 27 is placed under the evaporator 26 and collects the melting frost water generated when the heat cables melts the ice. The tray is further connected to the drainage pipes (not shown) guiding the water out to the machine compartment 23 where it preferable is vaporized on a tray by the compressor heat. The motor and fan 28 is positioned substantially above the evaporator and preferably during operation brings air through the evaporator. It may also be possible to operate the motor in an opposite direction to remove frost ice collected on the fan blades. FIG. 3 shows a cross sectional view of the refrigerated air supply system. The water-collecting tray is not visible in this figure.

As illustrated in FIG. 3, the evaporator 26 is placed in a vertical position just behind the return ducting part 25. As described later air will be able to flow vertically upwards in the space between the return ducting part and the inner wall side 16 or sides against which said part is placed, in which space the evaporator also is placed. The fan and motor 28 can also be seen, said motor having a horizontal axis 29 and a vertical fan with fan blades 36. It should be understood a person skilled in the art that other arrangements of the evaporator and the fan and motor also fall within the scope of the invention. For instance, the axis may lean a certain degree in order to achieve better operating conditions.

The arrangement of the evaporator 26 and fan and motor 28 much depends on the design of the return ducting part 25. This part will now be described in relation to FIG. 4-7. There are some demands on said part 25. First of all, it is essential that the ducting part is designed to interact with the cabinet compartment. Secondly, it is very important the part occupies as little volume as possible. Moreover, the part should also be designed so that the evaporator, fan and motor fits behind it. Finally and most important, the return ducting part should be designed so that the best operating condition is achieved for the cabinet.

Figure 4:
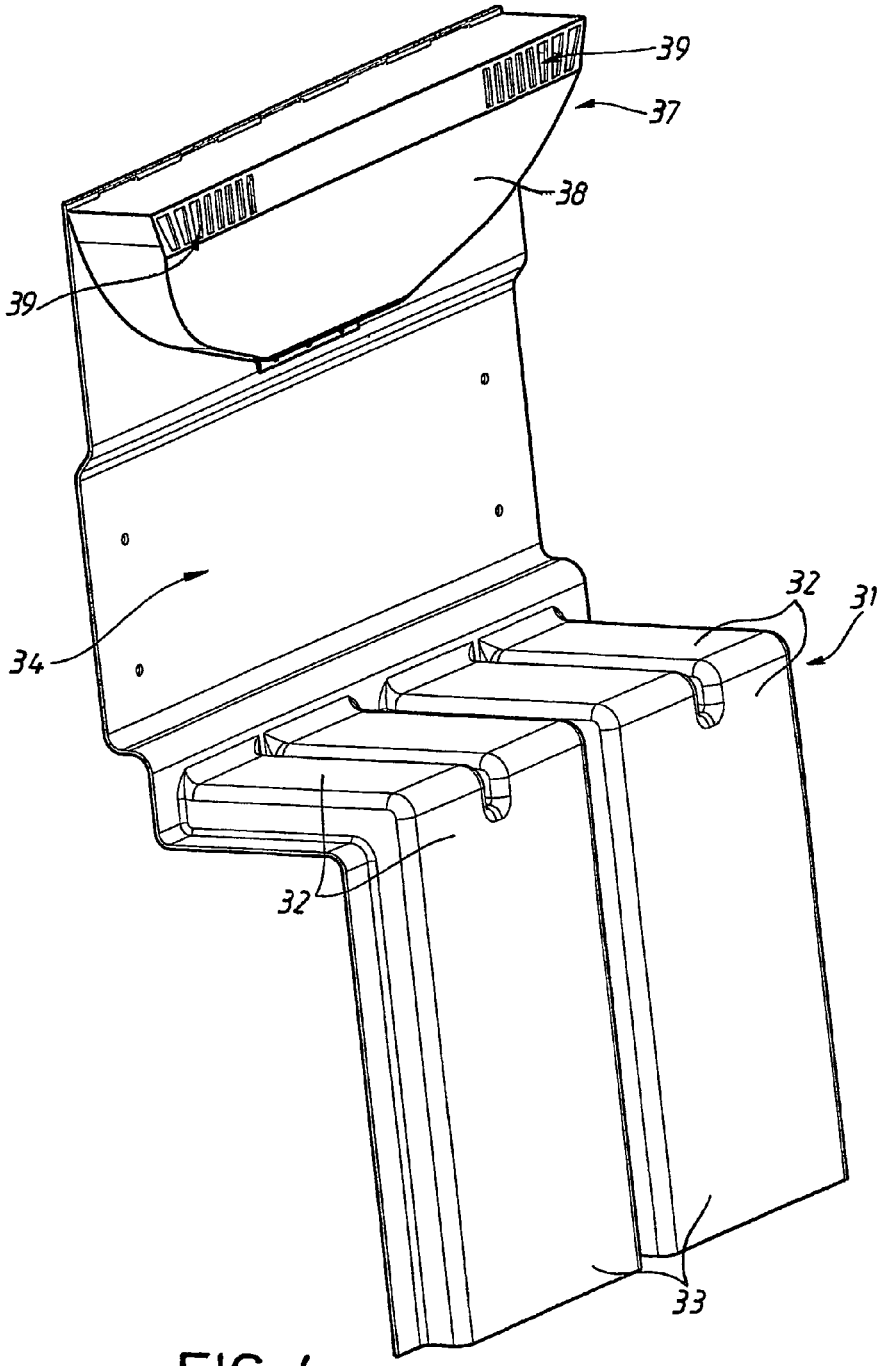
FIG. 4 shows a front perspective view of the return ducting part according to FIG. 1.
Figure 5:
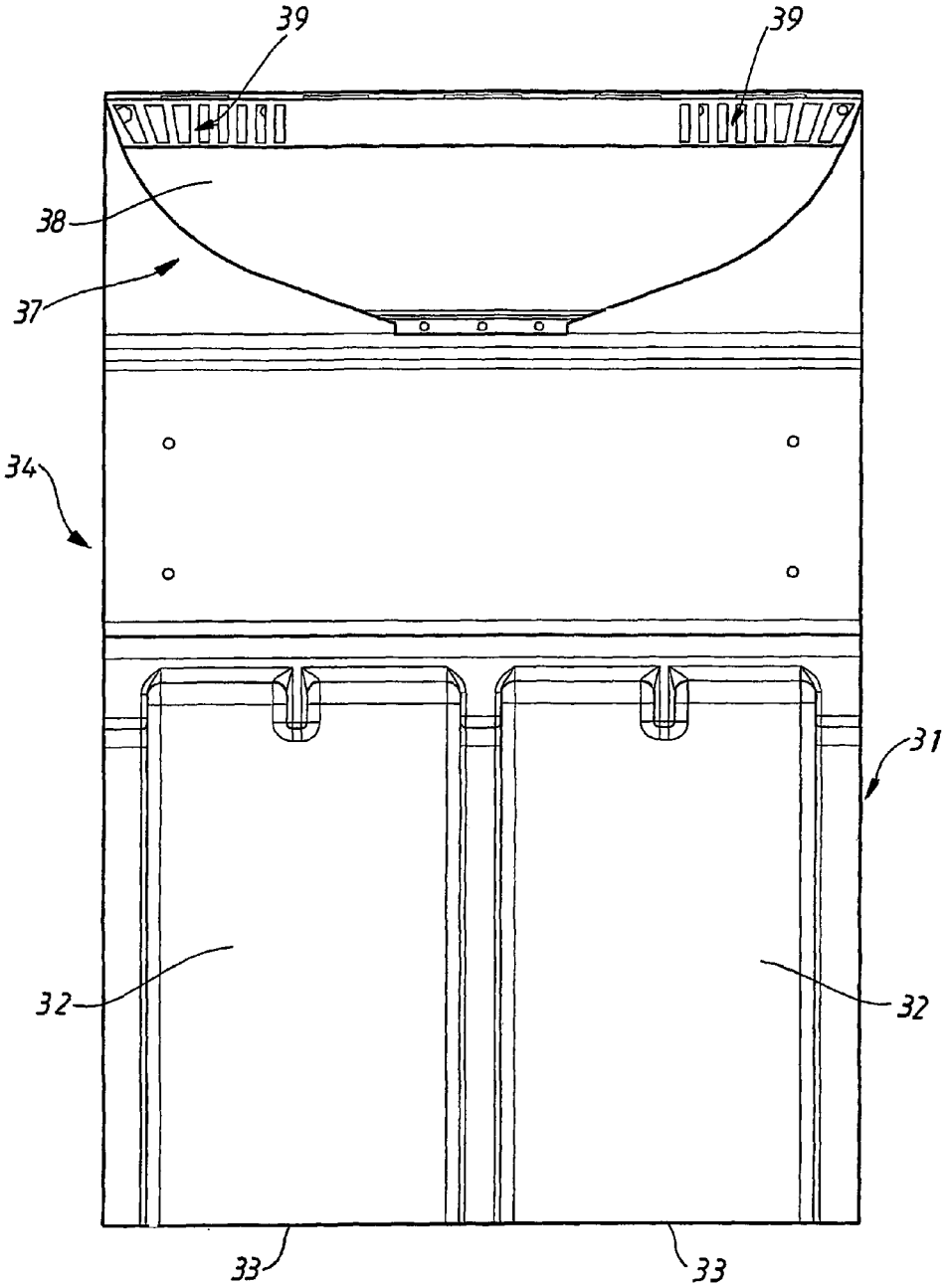
FIG. 5 shows a front view of the return ducting part according to FIG. 4.
Figure 6:
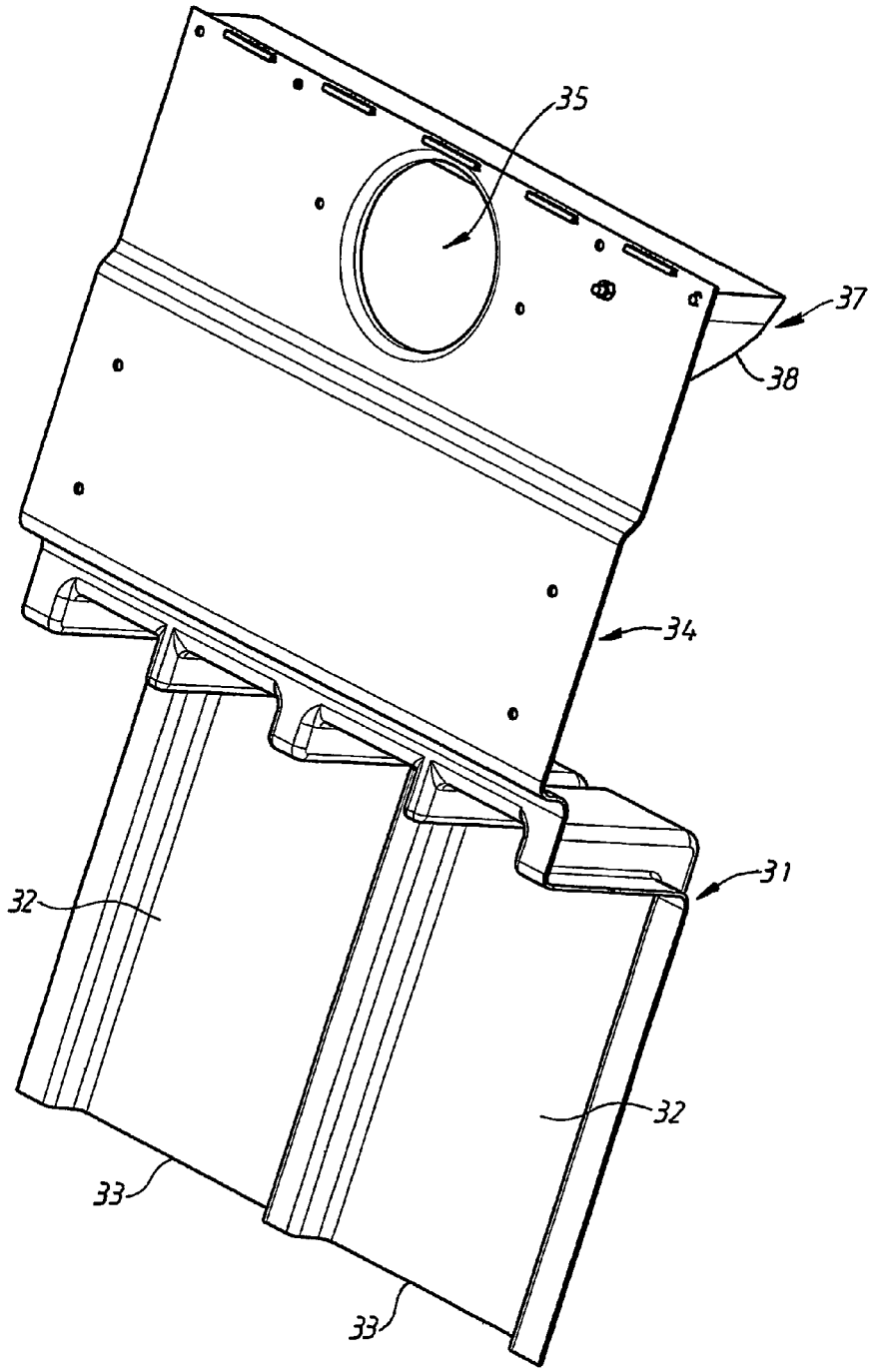
FIG. 6 shows a back perspective view of the return ducting part according to FIG. 1.
Figure 7:
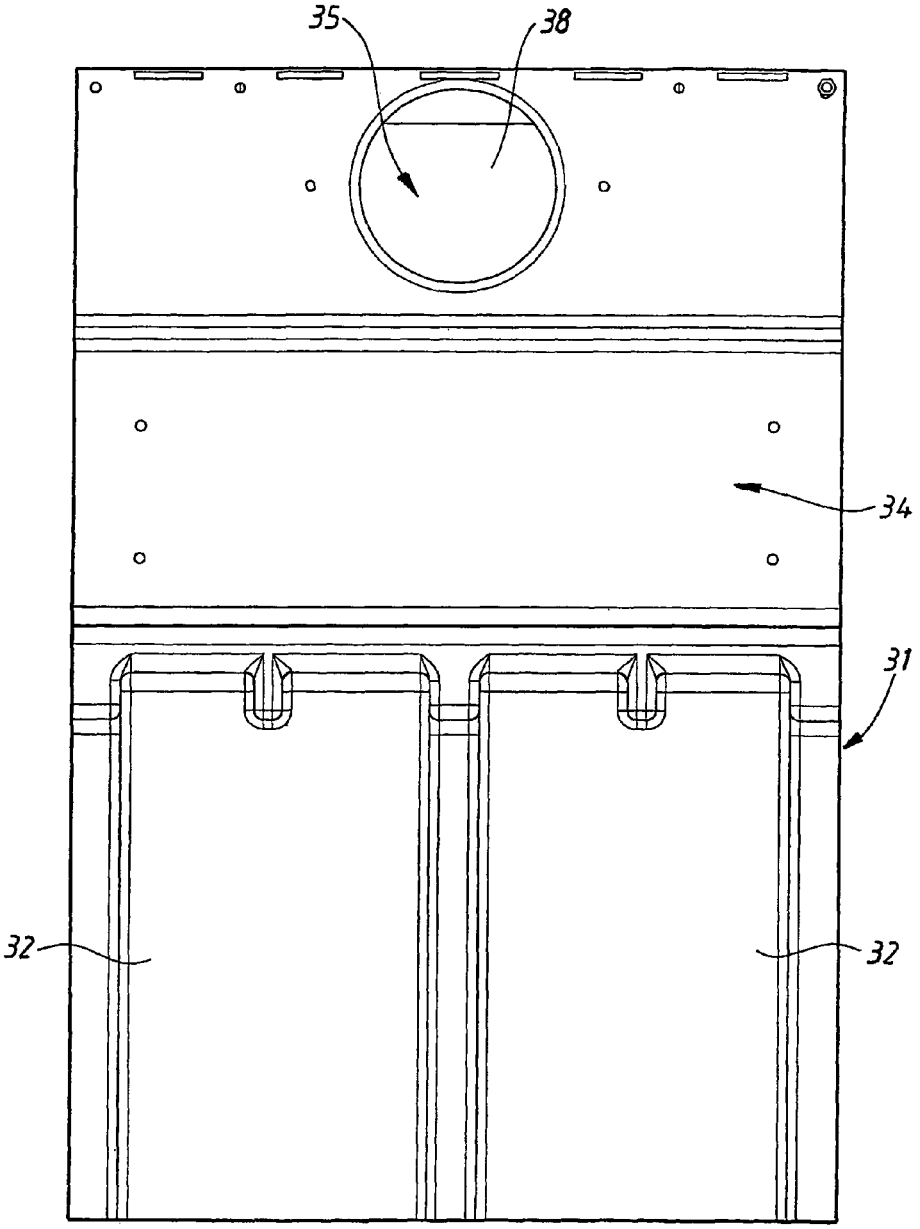
FIG. 7 shows a back view of the return ducting part according to FIG. 6.

FIG. 4 shows an illustrative embodiment of the return ducting part 25 in a front perspective view, said front facing the freezer compartment 17 when mounted therein. FIG. 5 shows a front view of the part. FIG. 6 shows a back perspective view, said back facing the evaporator 26, fan and motor 28. FIG. 7 shows a back view. Referring to FIGS. 4 and 6 the return ducting part will now be described in more detail. The return ducting part 25 comprises a lower 90 degrees angled piece 31 and an upper enclosing piece 34 preferably made in one piece. The angle of the lower piece corresponds to the angle of the machine compartment walls 24 separating the freezer compartment 17 from the machine compartment 23. This means that the piece is designed to cooperate with the shape of the inner walls 16 forced to their shape by the machine compartment. It should be understood by a person skilled in the art that a different shape of the return ducting part also falls within the scope of the invention, which is to design the return ducting part 25 so that it cooperates with the cabinet freezer compartment inner walls 16 in the best way possible and also solves the objects of the cooling system described earlier in this document.

In this embodiment, the lower piece 31 has a 90-degree angle. Moreover, the piece is designed with ducting means 32 in a manner so that ducts are created when the return ducting part 25 is placed against the inner wall or walls 16 of the freezer compartment 17. When placed inside the compartment the lowest part 33 of the lower piece will not reach all the way down to the floor of the freezer compartment 17. Instead there will be a distance between the said floor and the lower piece creating an inlet where air may flow from the floor area in into the ducts and upwards towards the space between the upper enclosing piece 34 and the inner wall or walls 16 against which the refrigerating part 21 is placed. A person skilled in the art will understand that another design of the inlet also falls within the scope of the invention, such a design for instance using a grill such as the grill opening 39 described further below.

As illustrated in the figures, the ducting means form two ducts at its lowest vertical part and four ducts at its upper horizontal part. One reason for that is that the design with four ducts will create a stronger construction, which is necessary since the horizontal part has to cope with heavy food products that may be placed thereon. Another reason is that the design with two ducts will improve the airflow conditions in the ducts and in the inlet. The main target is to enable for air to flow as effective as possible.

The return ducting part 25 preferably extends between two opposite sidewalls of the inner walls 16 where the contact between the part and each wall is made to achieve an airtight attachment. The air should not be able to leak out on its way upwards between said part and the inner wall or walls 16. Another alternative is to design the return ducting part 25 so that it does not extend all the way between two opposite walls. The main demand is however always to avoid air leakage and in such a case sidewalls at the return ducting part are needed instead. As mentioned earlier it should be understood by the person skilled in the art that another design of the return ducting part is possible within the scope of the invention. This may for instance result in that the refrigerated air supply system 21 could be positioned in one of the corners of the freezer compartment 17 against one or more of the inner walls 16.

Another alternative is to design the return ducting part 25 as a separate unit with surrounding walls forming the ducts mentioned and the space inside which the evaporator 26 is positioned. In such an embodiment the inner wall or walls does not contribute to enclose said ducts or the evaporator. Instead the return ducting part is only placed next to the wall or walls. Moreover, the scope is not only the position of the refrigerated air supply system. It is also among other things the achievement of a refrigerating airflow through the compartment bringing heat and moisture out of the freezer compartment. This is enabled by arranging the parts: the return ducting part 25, the evaporator 26 and the fan and motor 28, in the most proper way inside the Chest freezer cabinet.

The upper enclosing piece 34 covers the evaporator 26 and the fan and motor 28 placed between said piece and the inner wall side or sides 16. Moreover, it makes sure that air flowing upwards from the lower piece is guided further upwards and through the evaporator. The enclosing piece is also designed to solve the demands mentioned earlier.

The return ducting part 25 has an opening 35 in its upper part. In FIG. 6-7 the circular opening is visible. As shown in FIG. 3 the fan blades 36 could preferably extend through the opening and move freely therein. Moreover, an airflow directing part 37 is attached to the return ducting part on the side of it which faces the freezer compartment. This directing part is an important part of the invention. The part is more visible in FIG. 3-5. Said part has a lower leaning section 38 directing the airflow from the opening 35 upward towards two opening grills 39. The air flowing out from the opening will be forced to pass through these grills in a high speed because of the limited area of those grills in relation the area between the return ducting part and the inner wall or walls 16.

It is very important that the fan and the airflow directing part 37 cooperate in an effective way. Therefore, the design of both parts and the position and direction should be considered. The illustrative embodiment proposes a suitable solution. However, it should be understood that other solutions also falls within the scope of the invention. This for instance means that the airflow directing part may have another arrangement of opening grills. However, it is important that the opening grill/-s discharge the airflow in the uppermost part of compartment. The reason for that will be described further later on. This means that the return ducting part needs to extend the entire way from the freezer compartment floor area all the way up to its most uppermost area.

Figure 8:
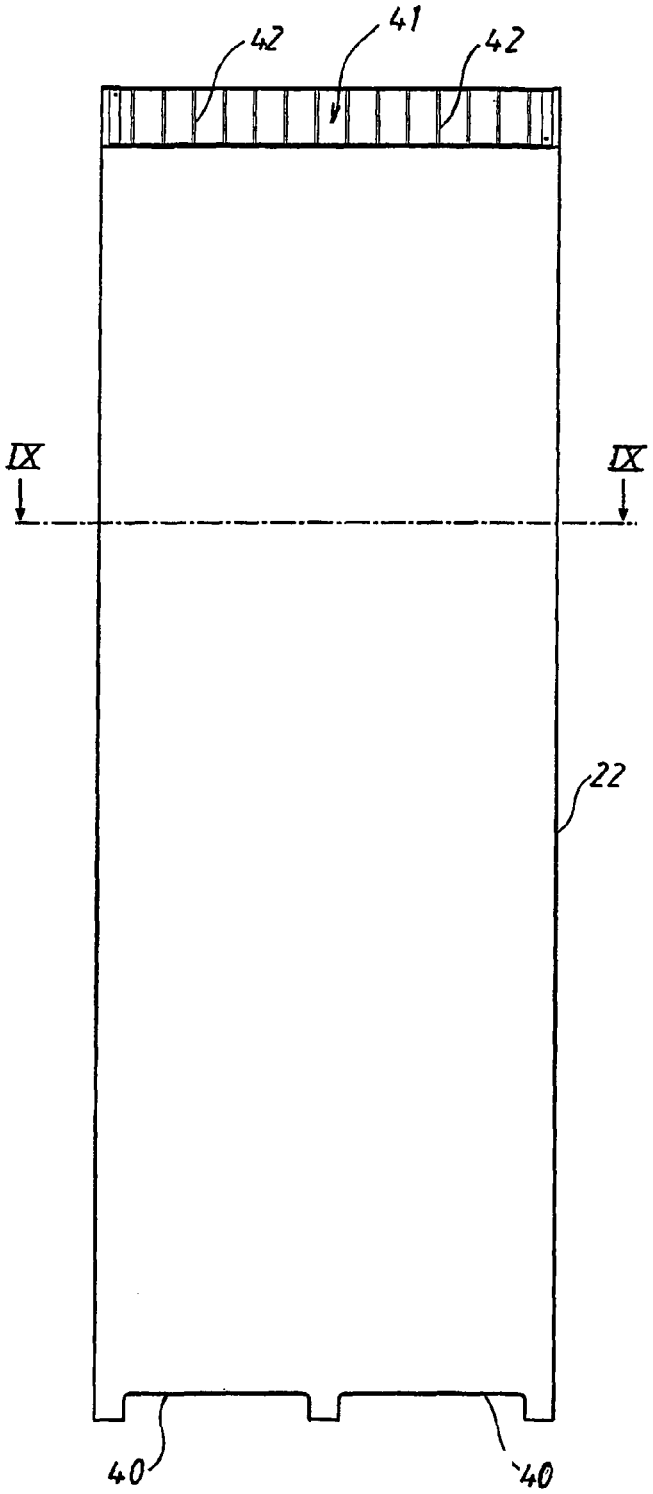
FIG. 8 shows a front view of a floor ducting part according to the present invention.
Figure 9:
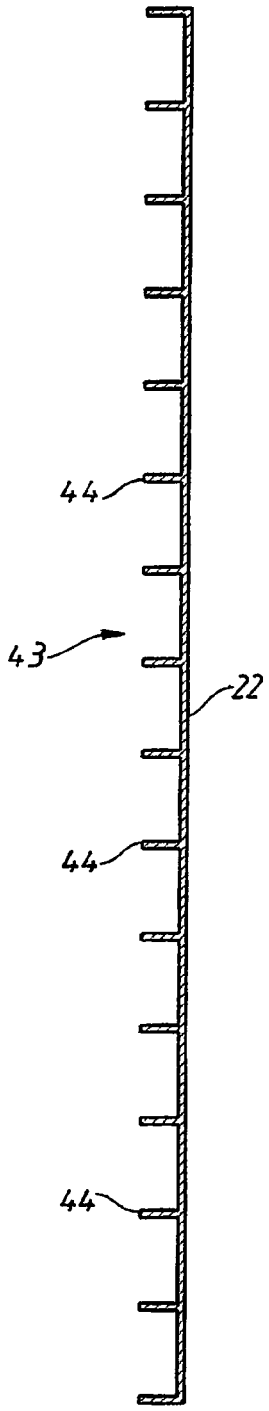
FIG. 9 shows a cross section at C-C of the floor ducting part according to FIG. 8.
Figure 10:
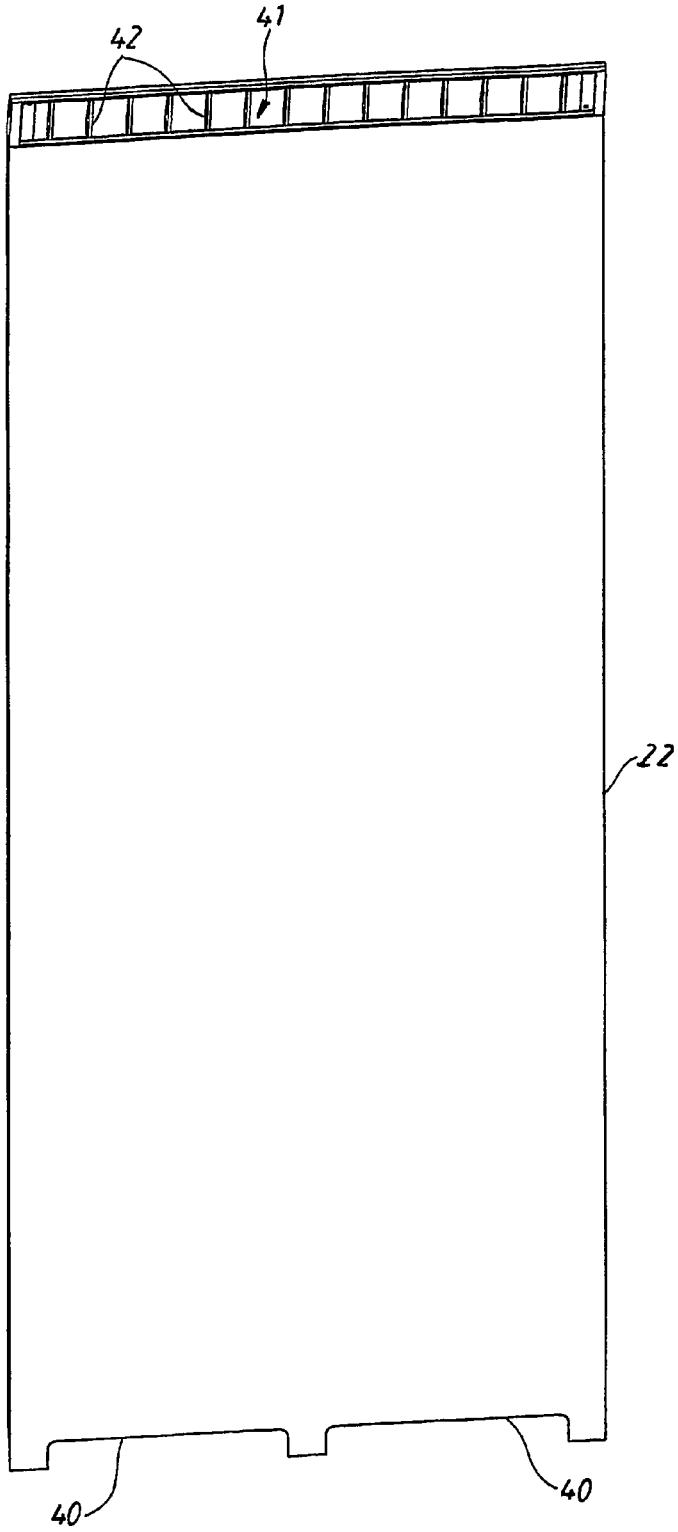
FIG. 10 shows a front perspective view of the floor ducting part according to FIG. 8.
Figure 11:
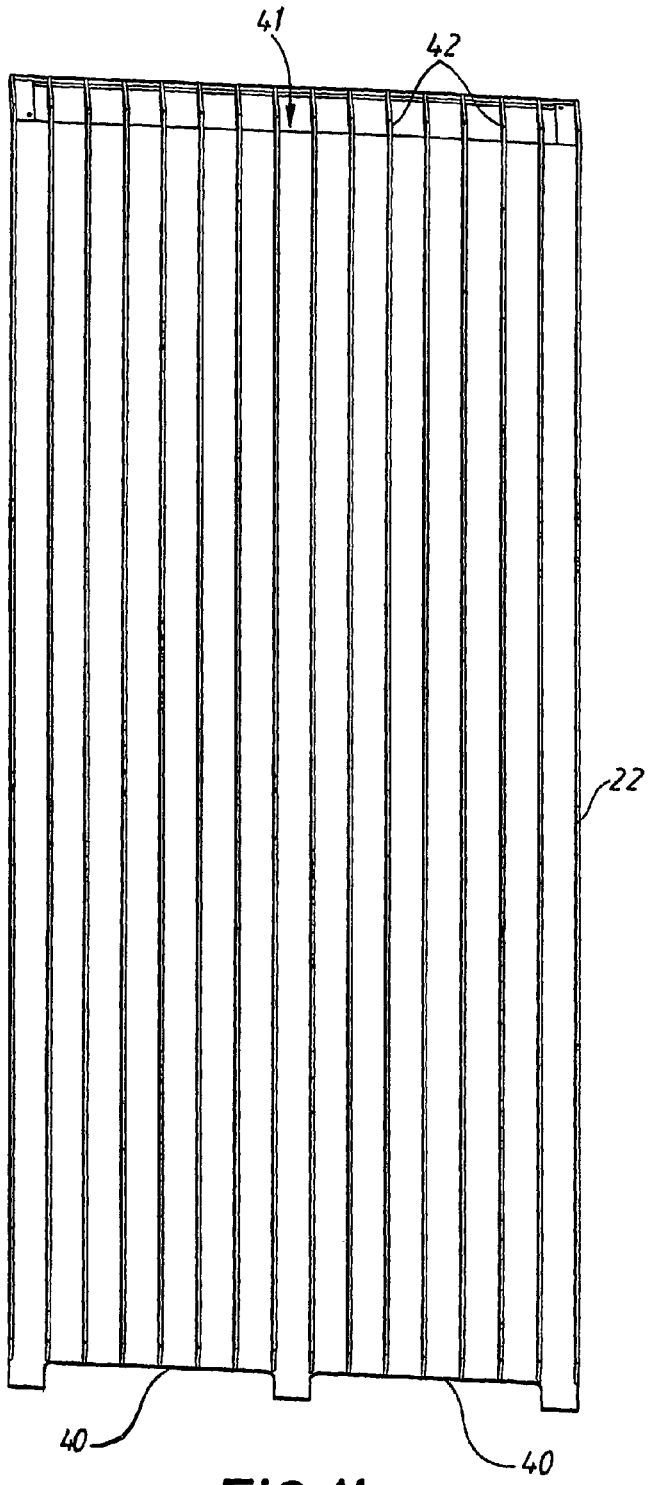
FIG. 11 shows a back perspective view of the floor ducting part according to FIG. 8.

Now moving over to the floor ducting part 22. The part is not necessary for the operation of the Chest freezer cabinet but will however result in an improvement in its operation. The floor ducting part will be described in relation to FIG. 8-11. FIG. 8 shows a front view of the part, FIG. 9 shows a cross sectional view at C-C of the same part, FIG. 10 shows front perspective view of the part and FIG. 11 shows a back perspective view of the part. In FIG. 1 the floor ducting part is shown together with the cabinet. In use, it will be placed horizontally on the floor inside the freezer compartment 17. The front side (see FIGS. 8 and 10) faces upward and the backside (see FIG. 11) faces the floor.

The floor ducting part 22 has a substantially flat front side. Moreover, it has two recesses 40 in one of its ends. When the floor ducting part is placed inside the compartment these recesses will cooperate with the lowest part 33 of the lower piece 31 so that air can flow from a space underneath the ducting part into the ducts formed between the lower piece and the inner walls side or sides 16. This airflow will be described further below. The ducting part also has an opening grill 41 in its other end, the grill comprising separated supports 42. As seen in FIGS. 1 and 10-11 the grill part is angled in relation to the rest of the ducting part. This means that when the ducting part rests on the freezer compartment floor, it will substantially cover the floor and create a leaning grill opening at the lowest left part, see FIG. 1, of the compartment. It should be understood by a person skilled in the art that opening grills having another certain angle or another design falls within the scope of the invention.

Now moving over to the backside of the floor ducting part. FIG. 9 shows a cross section of the ducting part. As shown, the backside 43 comprises separated ribs 44. These ribs have a common distance in relation to each other and have the same length. In FIG. 11 it can be seen that these ribs extend all the way between the recesses 40 and the grill opening 41. The supports 42 correspond with the ribs 44 in the illustrative embodiment. It should be understood by a person skilled in the art another distance and design of the ribs also falls within the scope of the invention. Its main tasks are to cope with the heavy weight of all the food products placed thereon, be light and easy to remove in order for the user to clean the freezer compartment and to provide floor ducts underneath the floor ducting part 22 connecting the grill opening 41 with the return ducting part 21. The ducts provided will be described further below. The ducting part is preferably made in one piece in a strong and light plastic material.

The front side of the floor ducting part 22 may for instance also be designed in a way so that grooves extending in certain directions along its surface are created. By doing that an airflow will always be able to pass upward or downward in the figure along the ducting part. If the front side only is flat, there is a risk that some food products will block the airflow along the ducting part. The grooves will make this blocking almost impossible.

The main task of the present is to provide a cooling system for a Chest freezer which enables a frost-free freezer compartment 17 and also improves the heat transfer between the refrigerated air supply system and the foodstuff. Moreover, it is also important to provide a cooling system for a chest freezer which is easy to implement into an ordinary chest freezer compartment for production. The present invention provides a solution to these problems.

Referring to FIG. 12 the operation of the chest freezer cabinet will now be described. The figure shows a cross section of the refrigerated air supply system 21 positioned inside the freezer compartment 17. The evaporator 26, the fan and motor 28 can be seen. Moreover, the inner walls 16 are shown together with the machine compartment walls 24, the outer walls 15 and the space 18 in which insulation is placed. The figure also shows the lower piece 31, the enclosing piece 34 and the airflow directing part 37. In the lowest part of the freezer compartment, the floor ducting part 22 is positioned resting on the compartment floor. The ribs 44 create ducts extending from the left to the right in the figure. The ducts connect the grill opening 41 with the lowest part 33 of the lower piece.

When operating the systems works as follows. A control system controls the operation of the refrigerated air supply system 21 and the compressor in order to achieve a good freezer environment based on the settings made by the user. The system may also comprise means in order to detect the conditions of the food products and adapts its operation according to that. Every system uses sensors placed in freezer compartment 17 and near the refrigerated air supply system 21 in order to detect the conditions, such as the temperature and maybe also the moisture level. The refrigerated air supply system also comprises frost-free means in the form of a heating wire attached to the evaporator. The operation of the frost-free means is for instance based on information from an ice-collecting sensor on the evaporator, conditions sensed by the other sensors or by a time schedule.

When operating, the fan and motor part 28 will create an airflow 45 that is forced out through the grill openings 39 of the airflow directing part 37 into the freezer compartment 17. The air will then be spread out in the compartment. Arrows 47 shows that. Most important is the airflow along the inner wall 46 of the lid 19. If there are some of the earlier mentioned grooves on the inner wall 46 there will not be any blocking risk of the airflow. This also concerns the inner walls 16 along which the airflow should also be able to flow. If the air flows sufficiently along the lid inner wall 46 it will also be able to flow vertically downwards into different parts of the compartment. Obviously, the airflow very much depends on how the food products are stored in the compartment. If there is a lot of airspace between them the airflow will be able to achieve a better reach and contact. On the other hand, if the user has been very ambitious storing as much as possible into the compartment, the airflow will be less even meaning that it will be less effective to reach and get in contact with the food products. In perfect conditions the airflow will reach all parts of the compartment and thereby be able to bring as much heat and moisture as possible out from the compartment.

The air is forced downwards in the freezer compartment 17 towards the outlet formed by the grill opening 41 at the floor ducting part. Since the grill opening 41 is positioned in the opposite direction in relation to the grill openings 39 at the airflow directing part 37, the airflow will have to cross the whole compartment. This is important in order to improve the airflow capacity. If there are some of the earlier mentioned grooves on the front side of the ducting part 22 there will not be any blocking risk of the airflow. The arrow 48 shows how the heated and moisturized airflow is flowing into the ducts formed underneath the ducting part. The airflow is then further guided to the right illustrated by the arrows 49. The air then flows upwards along the ducts formed between the lower part 31 and the inner walls 16 towards the evaporator 26, see arrows 50.

When reaching the evaporator 26 the airflow will pass through it. The heat will then be collected by the evaporator and moisture be condensed on the evaporator fins. The colder and dryer airflow will then flow out towards the fan and motor 28, see arrow 51. The airflow has thereby reached its original position. The fan and motor then again forces it out into the freezer compartment. The control system will operate the fan and motor and the compressor so that the evaporator removes the right amount of heat. The frost-free system will also melt and remove the frosted condense water collected, so that the refrigerator system keeps its efficiency.

The chest freezer may also be used without the floor ducting part 22. The distance between the lowest part 33 of the return ducting part and the freezer compartment floor will then form the opening into which the air from the grill opening 39 will flow. This will result in that the airflow will not reach the whole compartment as good as when the ducting part is used.

Figure 13:
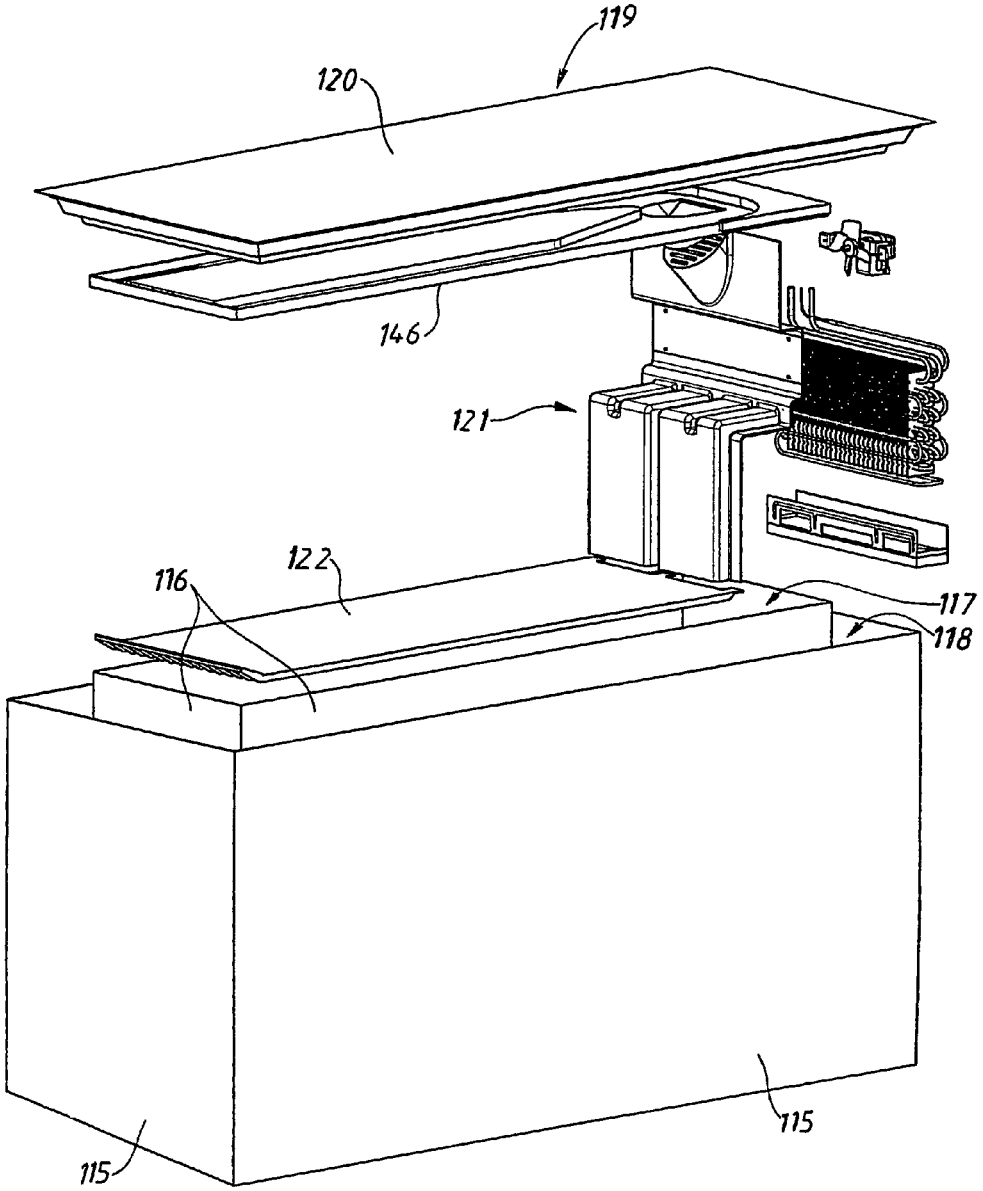
FIG. 13 shows an exploded perspective view of the refrigerated air supply system according to the present invention positioned inside a cabinet.

A second illustrative embodiment of the present invention will now be described in relation to the accompanied FIGS. 13-36. FIG. 13 shows a chest freezer cabinet in which a refrigerated air supply system is implemented. The cabinet contains outer walls 115 defining the outer dimensions of said cabinet. These walls are normally made in metal. Moreover, the cabinet also comprises inner walls 116 defining the outer dimensions of the chest freezer compartment 117. In the space 118 between the outer and inner walls an insulation layer is formed, said layer enclosing the floor and side inner walls. The inner walls 116 may for instance be designed with grooves (not shown) that extend in certain directions along its surface. By doing that an airflow will always be able to pass upward or downward in the figure along the inner wall 116. If the inner wall 116 only is flat, there is a risk that some food products will block the airflow along the walls. The grooves will male the blocking almost impossible.

The cabinet also comprises a door or lid 119, from now on named door, which in its closed, horizontal position contributes to enclose said freezer compartment 117. The door is preferably hanged by hinges (not shown), which guides said door between its open and closed position. Moreover, gaskets are used (not shown) which contributes to achieve an airtight sealing of the compartment. The door also has an outer wall 120 and a lid ducting part 146 between which insulation is placed. Together, with the rest of the cabinet the compartment is thereby sufficiently insulated to keep its freezing temperature. The lid ducting part is an important part of the invention and will be described thoroughly below in the application.

FIG. 13 shows important parts of the cooling system, which system defines the scope of the present invention. The important parts are the refrigerated air supply system 121, the floor ducting part 122 and the lid ducting part 146. The system will be described more in details in relation to FIG. 14-19, floor ducting part in relation to FIG. 20-23 and the lid ducting part in relation to FIG. 24-31. The system is in the illustrative embodiment positioned inside the space enclosed by the outer walls 115.

Figure 32:
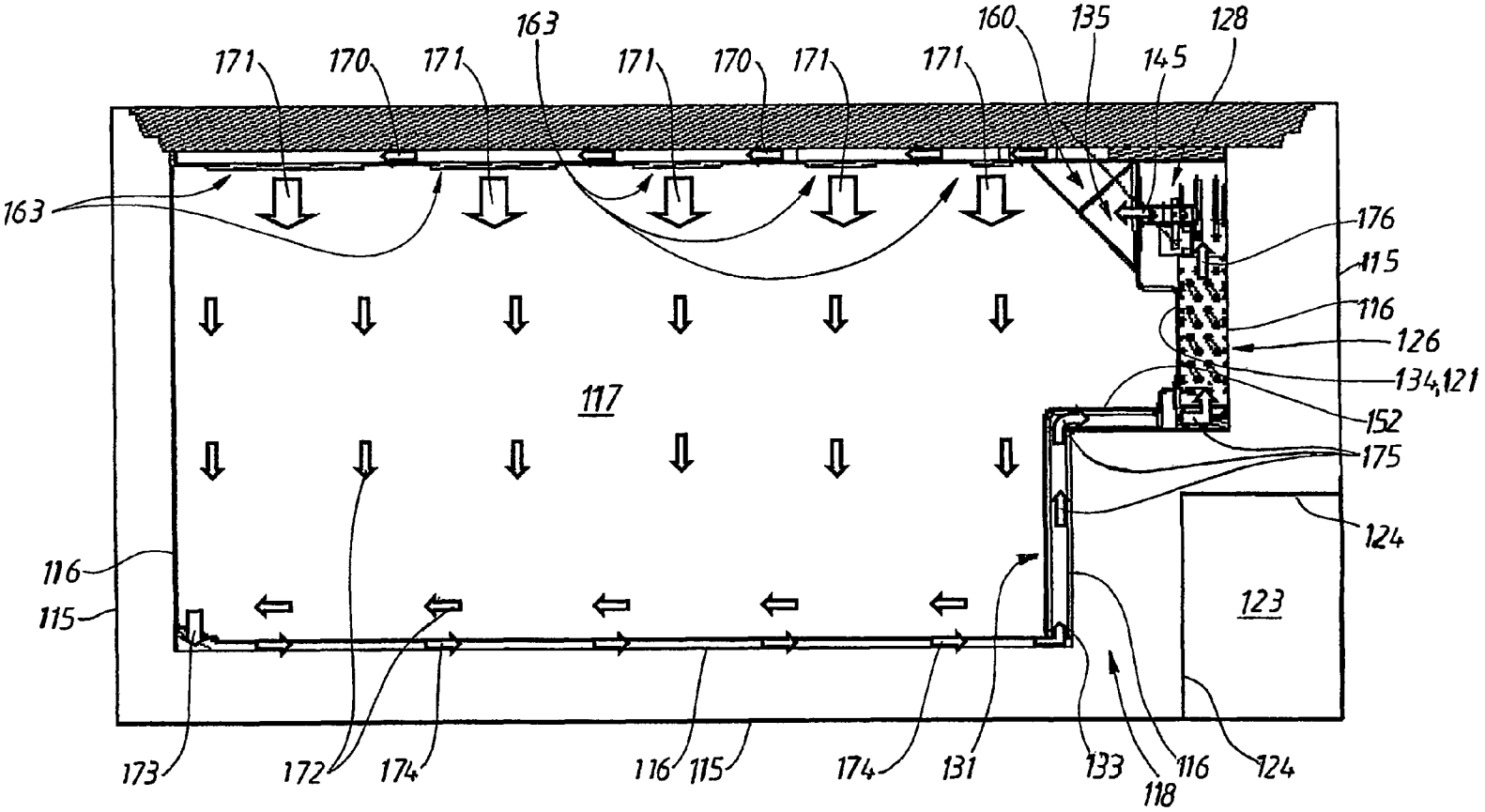
FIG. 32 shows a cross sectional view of the cabinet according to FIG. 13

The cabinet also comprises a machine compartment 123, see FIG. 32, positioned in the lowest right part of the cabinet shown in FIG. 13. In this compartment the compressor 100 and means (not shown) for frost water drainage are positioned. The compartment preferably has an opening (not shown) facing the area surrounding said cabinet in order for heat from the compressor to be removed efficiently. The machine compartment does not have any opening facing the freezer compartment 117. The means for frost water drainage could for instance comprise a heated tray (not shown) on which the frost water is vaporized. The heating energy from the compressor enables this. Other solutions for frost water drainage are of course possible. The frost water originates from the refrigerated air supply system 121 described further below, and is drained from the refrigerated air supply system to the machine compartment through at least one drainage pipe connecting the system with the heated tray or else.

Moreover, pipes connect the refrigerated air supply system 121 with the compressor in order for the refrigerant to circulate and transport the heat energy collected at the evaporator. Other parts, such as a control system (not shown) and sensors (not shown) do also communicate with each other, the refrigerated air supply system and the compressor. The pipes together with the compressor, the water drainage means, the refrigerated air supply system and the control system with sensors together forms the cooling system operating said chest freezer.

The volume occupied by the machine compartment 123 results in that the freezer compartment 117 loses some of its volume. Inside the compartment the inner walls 116 will therefore form a shelf plane 152. This is shown in FIG. 32. In common wording the machine compartment is called the "doghouse". In FIG. 32, showing a cross sectional side view of the cabinet, the machine house is numbered 123. The figure shows that a Chest freezer cabinet, which despite the inner walls 116, has the outer walls 115.

In FIG. 32 a machine compartment walls 124 defines the compartment 123. The machine compartment walls separate the freezer compartment 117 from the compressor and insulation is also placed in the space between the inner walls 116 and the machine compartment walls 124 to avoid compressor heat to reach the freezer compartment. Moreover, the outer wall 115 also surrounds the machine compartment except for at least one opening ventilating compressor heat from the machine compartment. This kind of solution is very common in chest freezers today. The machine compartment wall is designed to allow for pipes to connect the freezer compartment with the machine compartment.

Figure 14:
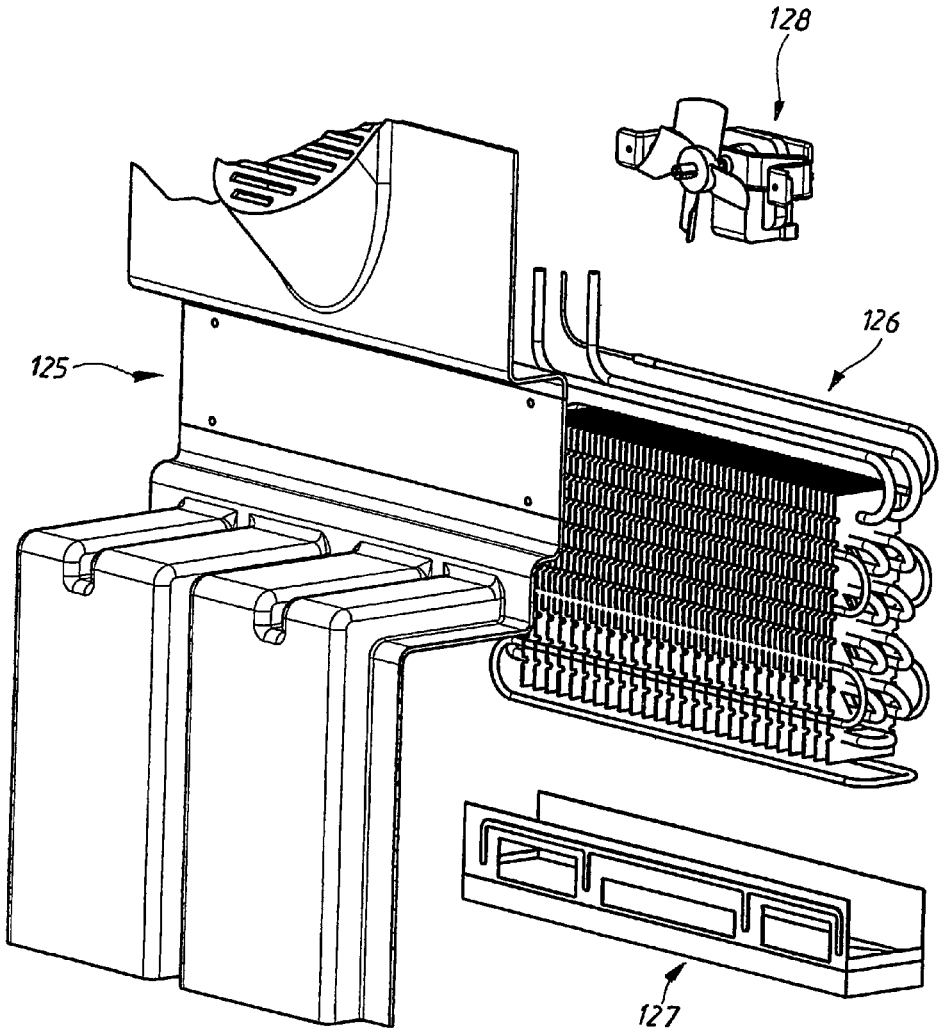
FIG. 14 shows an exploded perspective view of the sole refrigerated air supply system according to FIG. 13.
Figure 15:
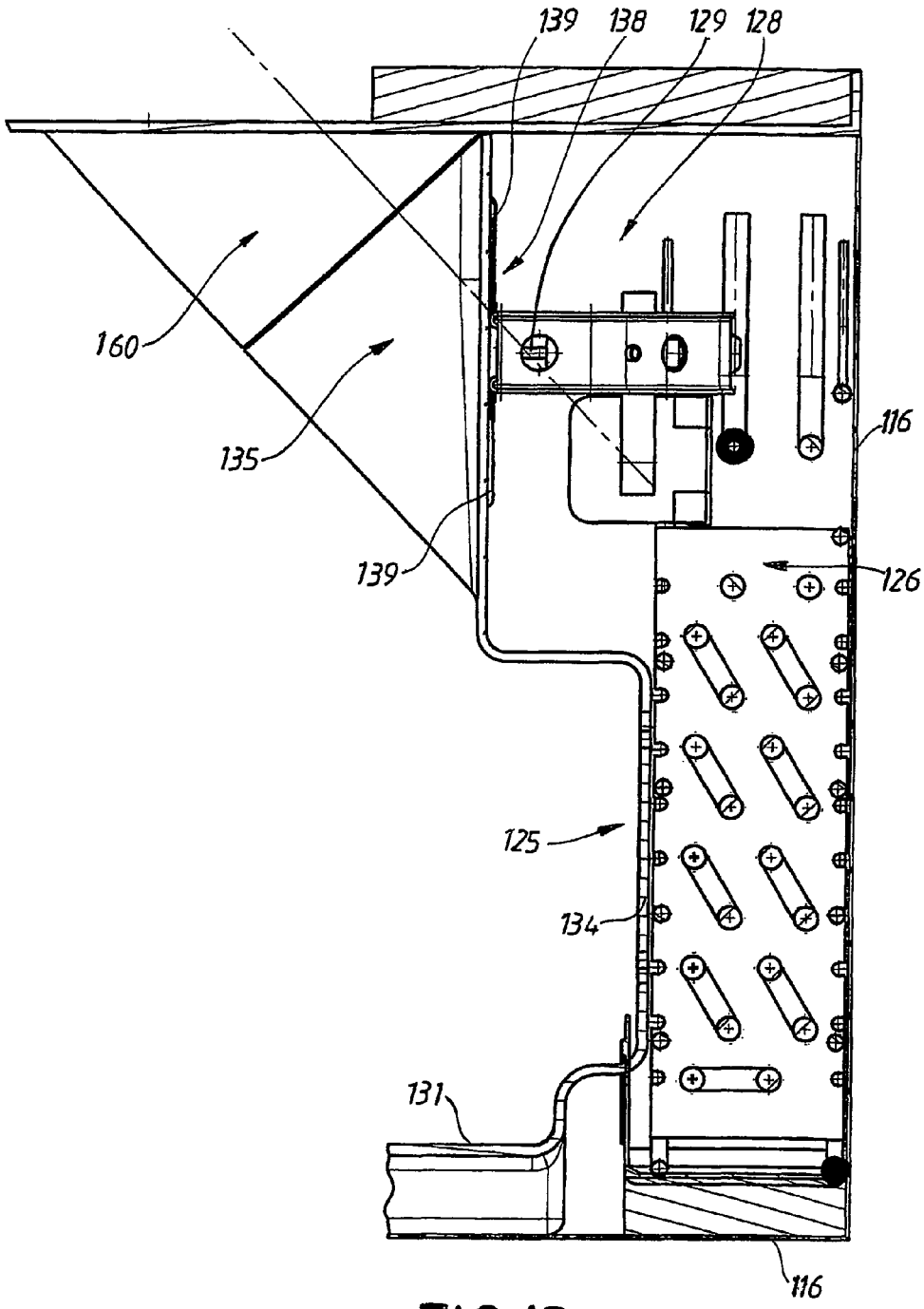
FIG. 15 shows a side view of the refrigerated air supply system according to FIG. 14.

FIG. 14 shows a perspective view of the refrigerated air supply system 121 and FIG. 15 shows a side view of the same system. The system according to the illustrative embodiment is as shown in FIGS. 13 and 32 positioned inside the freezer compartment 117. In FIG. 32 it can be seen how the refrigerated air supply system is designed to fit with the compartment shape formed by the machine compartment. It should be understood by a person skilled in the art that the refrigerated air supply system may also be placed in a special compartment separated from the freezer compartment, meaning that walls divides the freezer compartment into a space inside which the system is positioned and a space forming the actual freezer compartment. Both spaces are then inside the volume enclosed by the insulation.

The refrigerated air supply systems 121 main parts are a return ducting part 125, an evaporator 126, a frost water-collecting tray 127 and a motor and fan 128. The evaporator is a common type with fins and tubes forming its design. The fins enable for a large contact surface with the surrounding air. The evaporator is further designed and positioned so that air can easily flow through it in a substantially vertical direction. The evaporator is connected to the compressor through pipes extending between the freezer compartment and the machine compartment. As illustrated in FIG. 13-15 and 32, the evaporator in the illustrative embodiment is positioned between the return ducting part 125 and the inner wall 116. A frost-free system compromising heat cables (not shown) is adapted to the refrigerated air supply system. The heat cables is placed on the fins and switched on regularly in order to melt and thereby remove frost ice collected on the evaporator. The moisturized air flowing from the freezer compartment 117 through the evaporator generates the frost ice.

The water-collecting tray 127 is placed under the evaporator 126 and collects the melting frost water generated when the heat cables melts the ice. The tray is further connected to the drainage pipes (not shown) guiding the water out to the machine compartment 123 where it preferable is vaporized on a tray by the compressor heat. The motor and fan 128 is positioned substantially above the evaporator and preferably during operation brings air through the evaporator. It may also be possible to operate the motor in an opposite direction to remove frost ice collected on the fan blades. FIG. 15 shows a cross sectional view of the refrigerated air supply system. The water-collecting tray is not visible in this figure.

As illustrated in FIG. 15, the evaporator 126 is placed in a vertical position just behind the return ducting part 125. As described later air will be able to flow vertically upwards in the space between the return ducting part and the inner wall side 116 or sides against which said part is placed, in which space the evaporator also is placed. The fan and motor 128 can also be seen, said motor having a horizontal axis 129 and a vertical fan with fan blades 139. It should be understood by the person skilled in the art that other arrangements of the evaporator and the fan and motor also fall within the scope of the invention. For instance, the axis may lean a certain degree in order to achieve better operating conditions.

The arrangement of the evaporator 126 and fan and motor 128 much depends on the design of the return ducting part 125 and the lid ducting part. The return ducting part will now be described in relation to FIG. 16-19. There are some demands on said part 125. First of all, it is essential that the return ducting part is designed to interact with the cabinet compartment. Secondly, it is very important the part occupies as little volume as possible. Moreover, the part should also be designed so that the evaporator, fan and motor fits behind it. The part should also be designed to cooperate with the lid ducting part in the best way possible. Finally and most important, the return ducting part should be designed so that the best operating condition is achieved for the cabinet.

Figure 16:
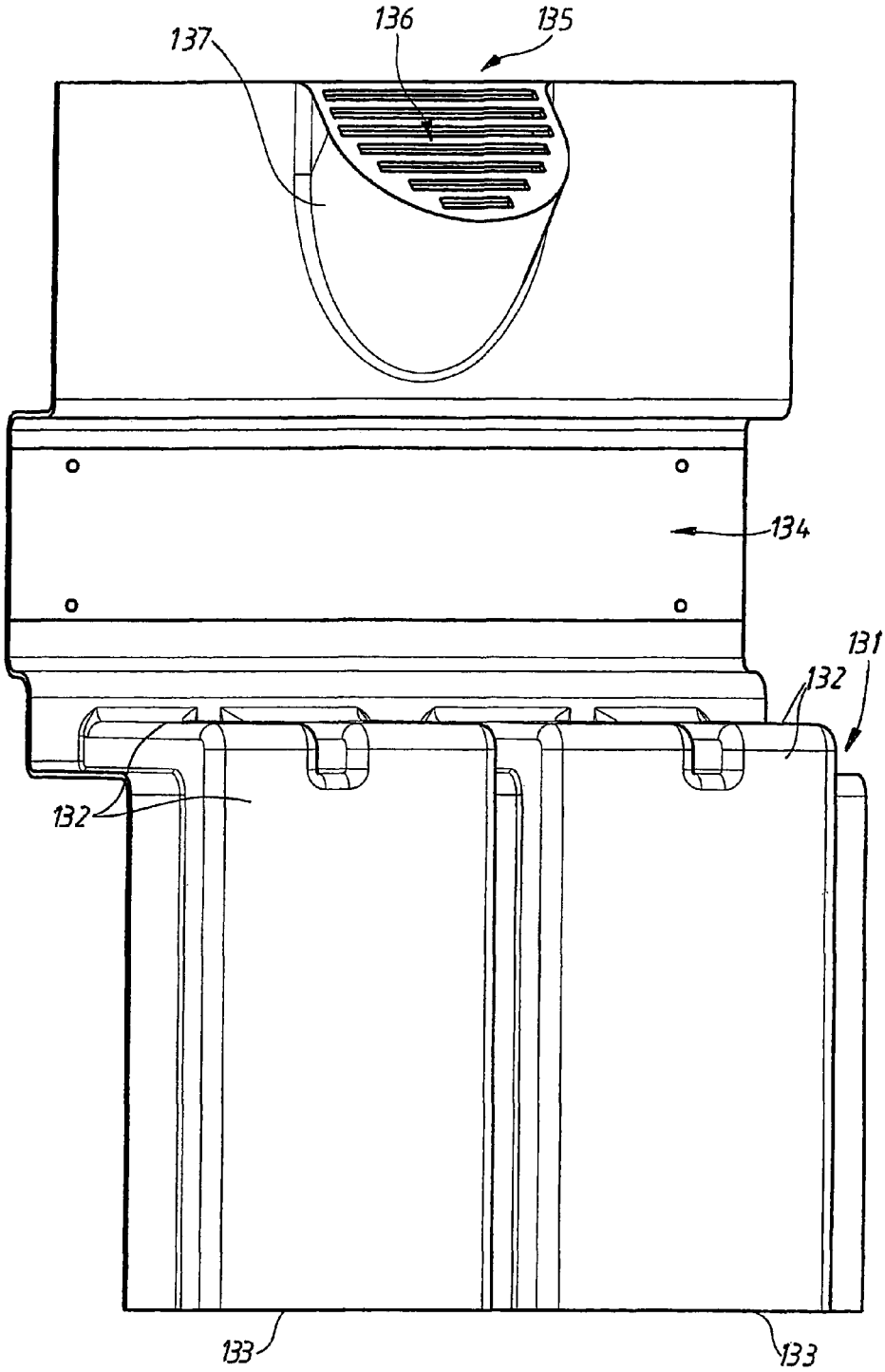
FIG. 16 shows a front perspective view of the return ducting part according to FIG. 13.
Figure 17:
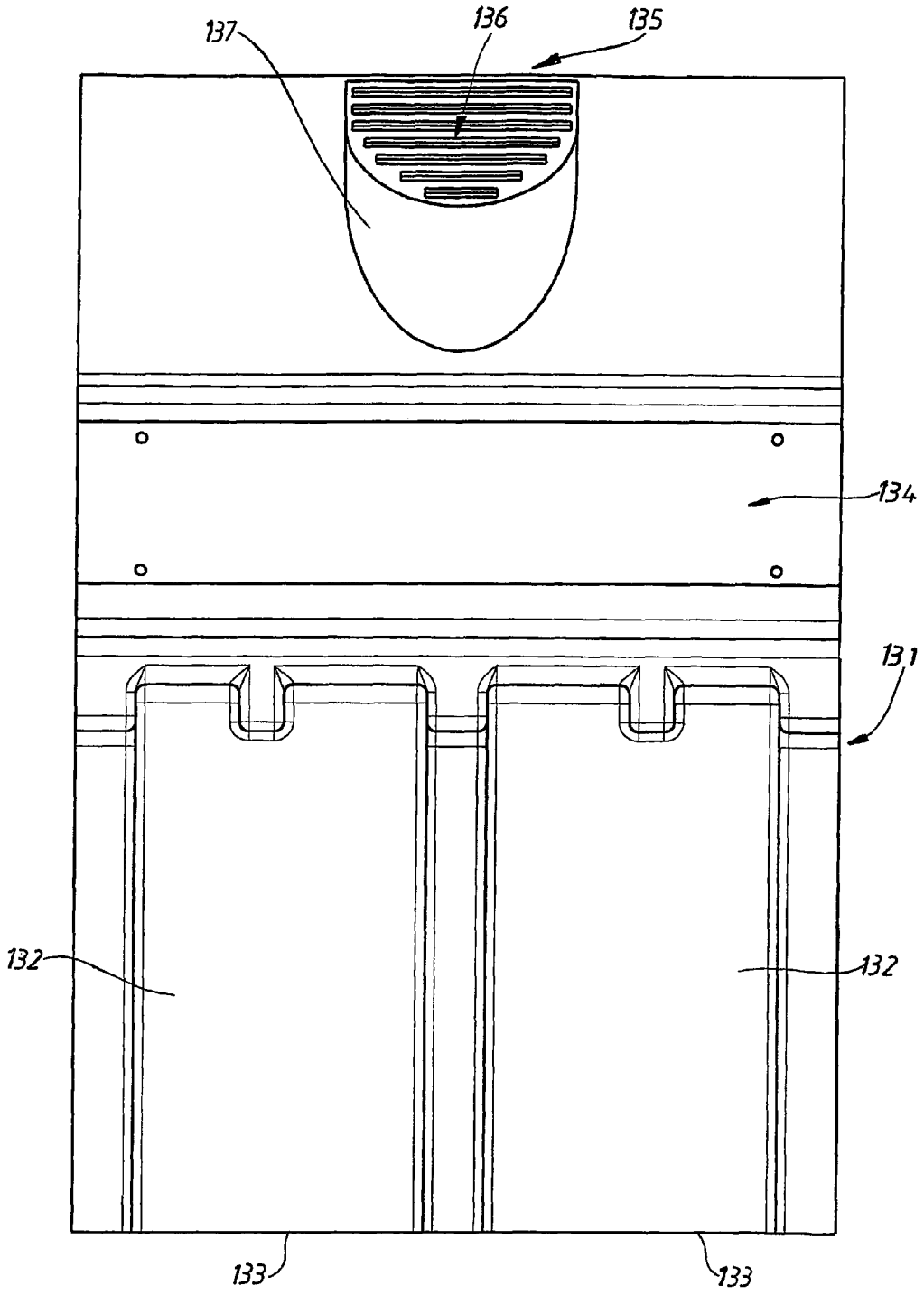
FIG. 17 shows a front view of the return ducting part according to FIG. 16.
Figure 18:
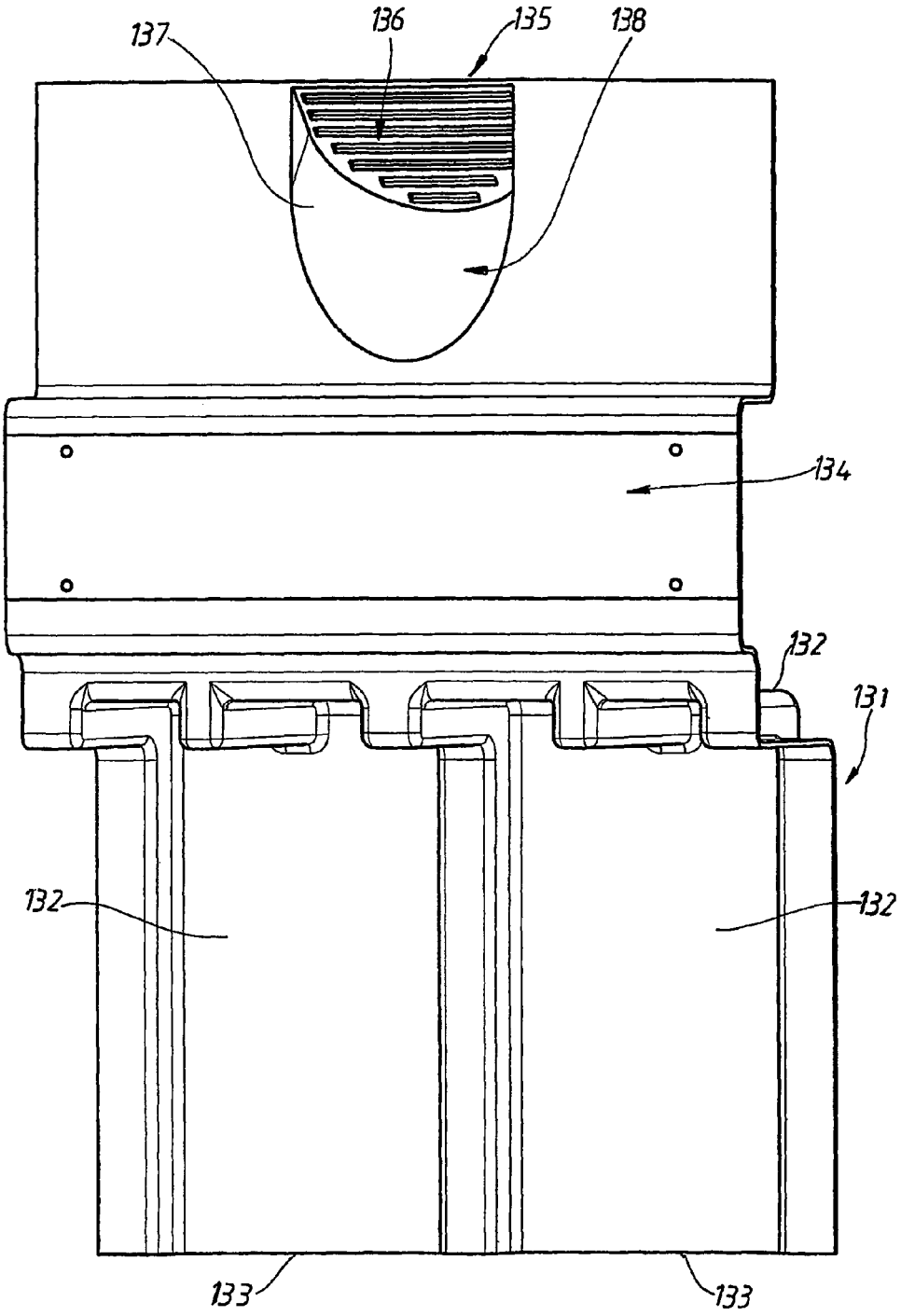
FIG. 18 shows a back perspective view of the return ducting part according to FIG. 13.
Figure 19:
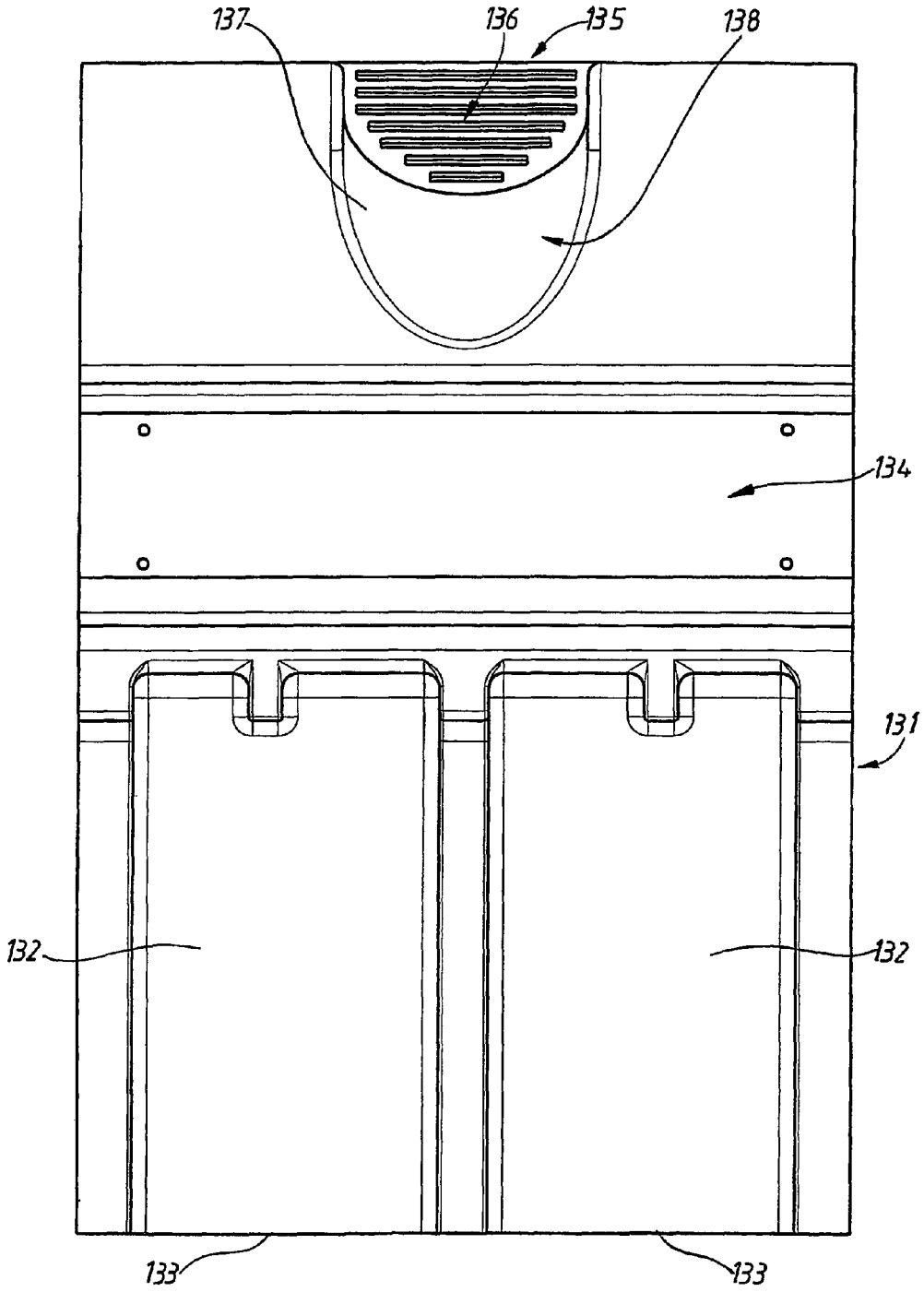
FIG. 19 shows a back view of the return ducting part according to FIG. 18.

FIG. 16 shows an illustrative embodiment of the return ducting part 125 in a front perspective view, said front facing the freezer compartment 117 when mounted therein. FIG. 17 shows a front view of the part. FIG. 18 shows a back perspective view, said back facing the evaporator 126, fan and motor 128. FIG. 19 shows a back view. Referring to FIGS. 16 and 18 the return ducting part will now be described in more detail.

The return ducting part 125 comprises a lower 90 degrees angled piece 131 and an upper enclosing piece 134 preferably made in one piece. The angle of the lower piece corresponds to the angle of the machine compartment walls 124 separating the freezer compartment 117 from the machine compartment 123. This means that the piece is designed to cooperate with the shape of the inner walls 116 forced to their shape by the machine compartment. It should be understood by a person skilled in the art that a different shape of the return ducting part also falls within the scope of the invention, which is to design the return ducting part 125 so that it cooperates with the cabinet freezer compartment inner walls 116 in the best way possible and also solves the objects of the cooling system described earlier in this document.

In this embodiment, the lower piece 131 has a 90-degree angle. Moreover, the piece is designed with ducting means 132 in a manner so that ducts are created when the return ducting part 125 is placed against the inner wall or walls 116 of the freezer compartment 117. When placed inside the compartment the lowest part 133 of the lower piece will not reach all the way down to the floor of the freezer compartment 117. Instead there will be a distance between the said floor and the lower piece creating an inlet where air may flow from the floor area in into the ducts and upwards towards the space between the upper enclosing piece 134 and the inner wall or walls 116 of the inner walls 116 against which the refrigerating part 121 is placed. A person skilled in the art will understand that another design of the inlet also falls within the scope of the invention, such a design for instance using a grill such as the grill opening 135 described further below.

As illustrated in the figures, the ducting means form two ducts at its lowest vertical part and four ducts at its upper horizontal part. One reason for that is that the design with four ducts will create a stronger construction, which is necessary since the horizontal part has to cope with heavy food products that may be placed thereon. Another reason is that the design with two ducts will improve the airflow conditions in the ducts and in the inlet. The main target is to enable for air to flow as effective as possible.

The return ducting part 125 preferably extends between two opposite sidewalls of the inner walls 116 where the contact between the part and each wall is made to achieve an airtight attachment. The air should not be able to leak out on its way upwards between said part and the inner wall or walls 116. Another alternative is to design the return ducting part 125 so that it does not extend all the way between two opposite walls. The main demand is however always to avoid air leakage and in such a case sidewalls at the return ducting part are needed instead. As mentioned earlier it should be understood by the person skilled in the art that another design of the return ducting part is possible within the scope of the invention. This may for instance result in that the refrigerated air supply system 121 could be positioned in one of the corners of the freezer compartment 117 against one or more of the inner walls 116.

Another alternative is to design the return ducting part 125 as a separate unit with surrounding walls forming the ducts mentioned and the space inside which the evaporator 126 is positioned. In such an embodiment the inner wall or walls 116 does not contribute to enclose said ducts or the evaporator. Instead the return ducting part is only placed next to the wall or walls. Moreover, the scope is not only the position of the refrigerated air supply system. It is also among other things the achievement of a refrigerating airflow through the compartment bringing heat and moisture out of the freezer compartment. This is enabled by arranging the parts: the return ducting part 125, the evaporator 126 and the fan and motor 128, in the most proper way inside the Chest freezer cabinet.

The upper enclosing piece 134 covers the evaporator 126 and the fan and motor 128 placed between said piece and the inner wall side or sides 116. Moreover, it makes sure that air flowing upwards from the lower piece is guided further upwards and through the evaporator. The enclosing piece is also designed to solve the demands mentioned earlier.

The return ducting part 125 has a specially designed airflow directing part 135 in its upper area. The directing part comprises a grill opening 136 and a tube part 137. This directing part is preferably molded in plastics in one piece with the return ducting part. When the return ducting part is placed in position inside the freezer compartment 117, the grill opening is leaning a certain angle, see FIG. 15-19. Moreover, the tube part is extending slanting upwards with a certain angle. This angle enables for the grill opening to face in the direction shown in the figures and also directs the airflow from the fan and motor side through the opening 138 upward towards and out through the opening grill.

It is very important that the fan and motor 128 and the airflow directing part 135 cooperate in an effective way. Therefore, the design of both parts and the position and direction should be considered. The illustrative embodiment proposes a suitable solution. However, it should be understood that other solutions also falls within the scope of the invention. This for instance means that the airflow directing part may have another arrangement. However, it is important that the grill opening/-s discharge the airflow into the lid ducting part 146. The reason for that will be described further later on. This means that the return ducting part needs to extend the entire way from the freezer compartment floor area all the way up to its most uppermost area.

Figure 20:
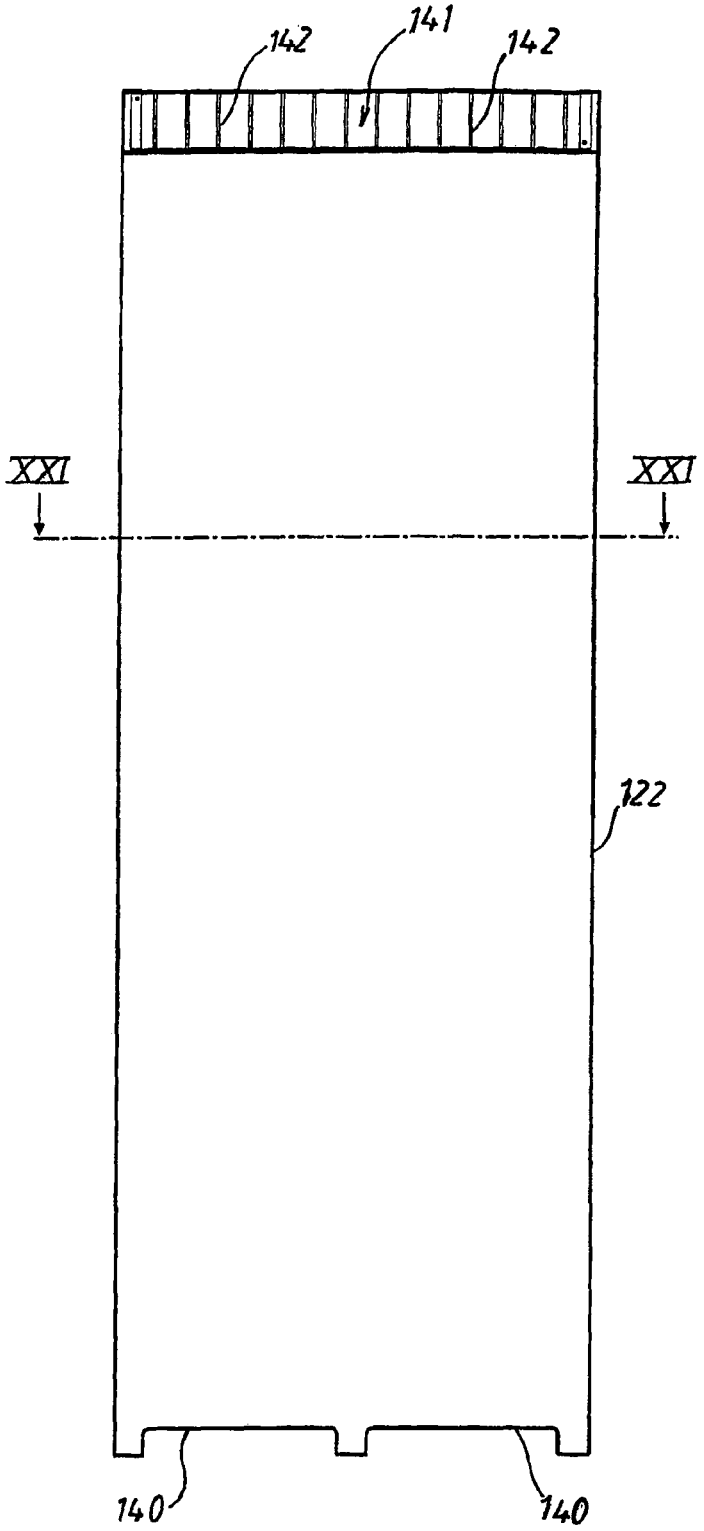
FIG. 20 shows a front view of a floor ducting part according to the present invention.
Figure 21:
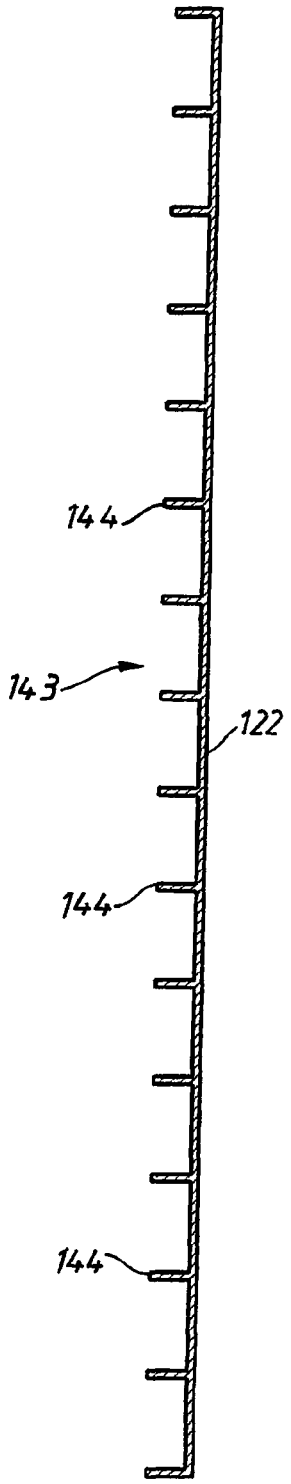
FIG. 21 shows a cross section at C-C of the floor ducting part according to FIG. 20.
Figure 22:
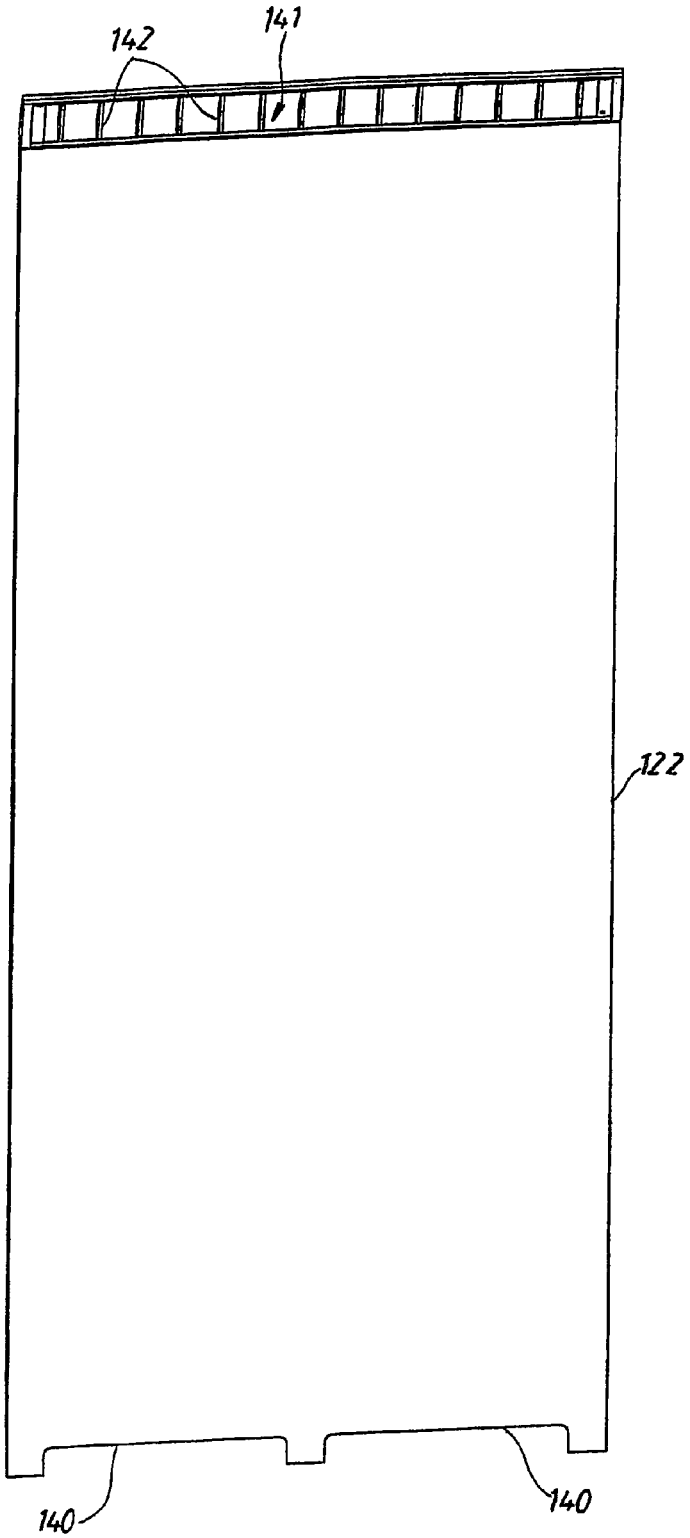
FIG. 22 shows a front perspective view of the floor ducting part according to FIG. 20.
Figure 23:
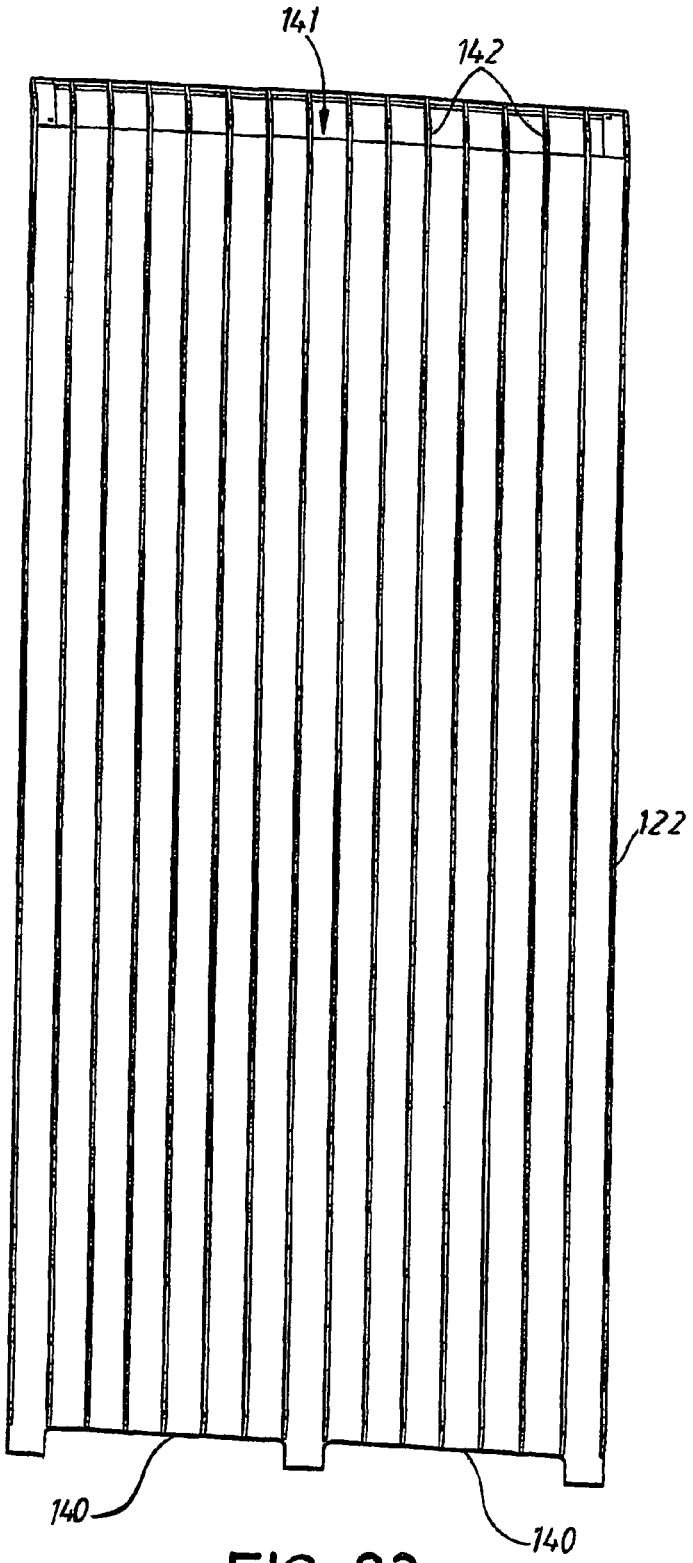
FIG. 23 shows a back perspective view of the floor ducting part according to FIG. 20.

Now moving over to the floor ducting part 122. The part is not necessary for the operation of the Chest freezer cabinet but will however result in an improvement in its operation. The floor ducting part will be described in relation to FIG. 20-23. FIG. 20 shows a front view of the part, FIG. 21 shows a cross sectional view at C-C of the same part, FIG. 22 shows front perspective view of the part and FIG. 23 shows a back perspective view of the part. In FIG. 13 the floor ducting part is shown together with the cabinet. In use, it will be placed horizontally on the floor inside the freezer compartment 117. The front side (see FIGS. 20 and 22) faces upward and the backside (see FIG. 23) faces the floor.

The floor ducting part 122 has a substantially flat front side. Moreover, it has two recesses 140 in one of its ends. When the floor ducting part is placed inside the compartment these recesses will cooperate with the lowest part 133 of the lower piece 131 so that air can flow from a space underneath the ducting part into the ducts formed between the lower piece and the inner walls side or sides 116. This airflow will be described further below. The ducting part also has an opening grill 141 in its other end, the grill comprising separated supports 142. As seen in FIGS. 13 and 22-23 the grill part is angled in relation to the rest of the ducting part. This means that when the ducting part rests on the freezer compartment floor, it will substantially cover the floor and create a leaning grill opening at the lowest left part, see FIG. 13, of the compartment. It should be understood by a person skilled in the art that opening grills having another certain angle or another design falls within the scope of the invention.

Now moving over to the backside of the floor ducting part. FIG. 21 shows a cross section of the ducting part. As shown, the backside 143 comprises separated ribs 144. These ribs have a common distance in relation to each other and have the same length. In FIG. 23 it can be seen that these ribs extend all the way between the recesses 140 and the grill opening 141. The supports 142 correspond with the ribs 144 in the illustrative embodiment. It should be understood by a person skilled in the art another distance and design of the ribs also falls within the scope of the invention. Its main tasks are to cope with the heavy weight of all the food products placed thereon, be light and easy to remove in order for the user to clean the freezer compartment and to provide floor ducts underneath the floor ducting part 122 connecting the grill opening 141 with the return ducting part 121. The ducts provided will be described further below. The ducting part is preferably made in one piece in a strong and light plastic material.

The front side of the floor ducting part 122 may for instance also be designed in a way so that grooves extending in certain directions along its surface are created. By doing that an airflow will always be able to pass upward or downward in the figure along the ducting part. If the front side only is flat, there is a risk that some food products will block the airflow along the ducting part. The grooves will make this blocking almost impossible.

The lid ducting part 146 will now be described in relation to FIGS. 13 and 24-31. According to FIG. 13, the lid ducting part is positioned at the lid 119. The part thereby faces the freezer compartment 117 when the lid is closed. The lid also contributes to enclose insulation inside the lid. As an alternative, the lid part may be mounted outside lid inner wall, which together with the outer wall 120 at the lid enclosed said insulation. In the FIG. 24-27 a first embodiment of the lid ducting part is shown and in FIG. 28-31 a second embodiment of the lid ducting part is shown. The main task for both lid ducting parts is to guide an airflow into the freezer compartment. The airflow originates from the fan and motor 128 and moves from the airflow directing part 135 into a space formed between the insulation alternately the lid inner walls and the ducting part 146. The airflow movement into the space is enabled by the cooperation between the grill opening 136 and the lid ducting part 146 when the lid is closed, see FIG. 13.

Figure 24:
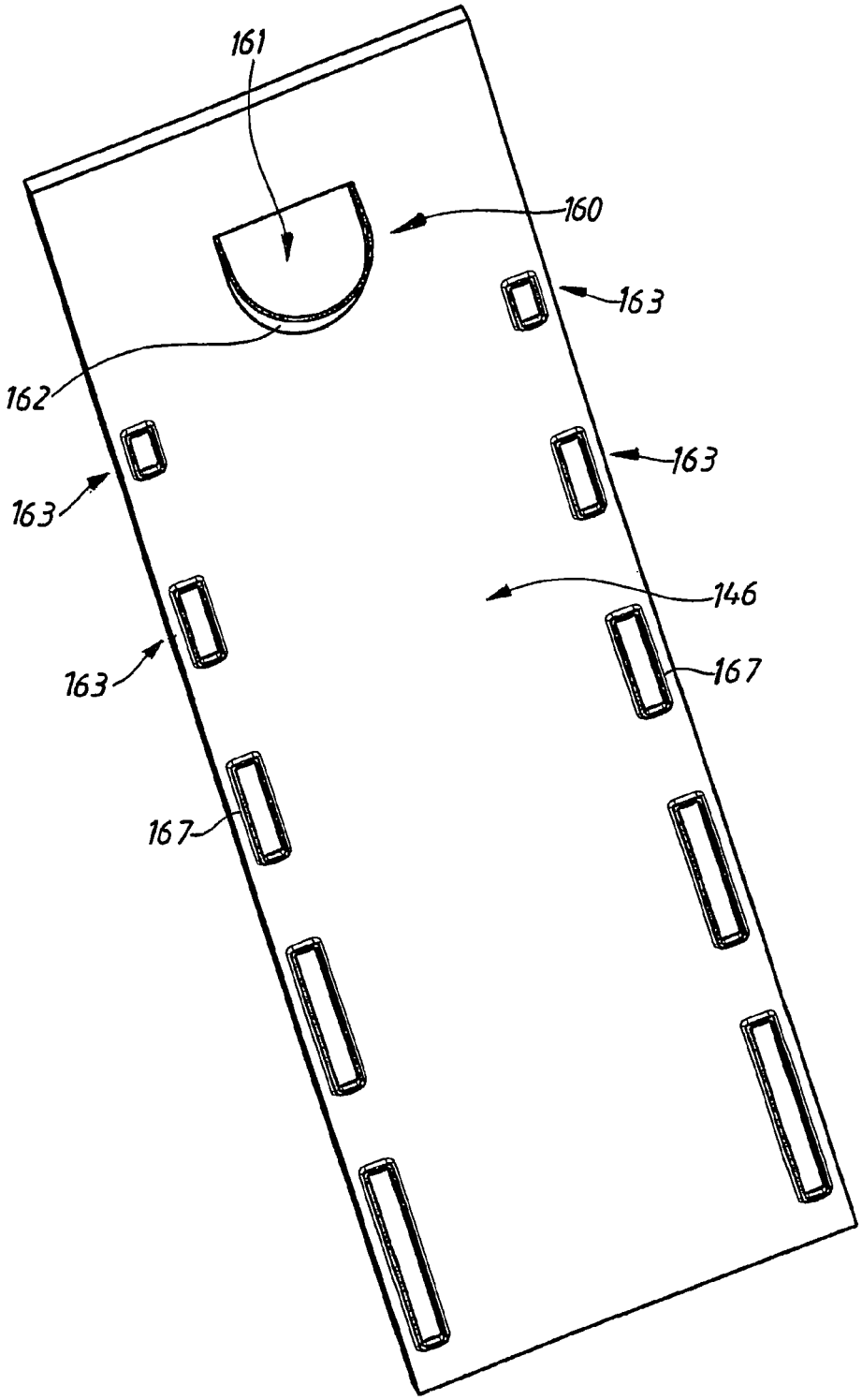
FIG. 24 shows a front perspective view of the lid ducting part according to the present invention.
Figure 25:
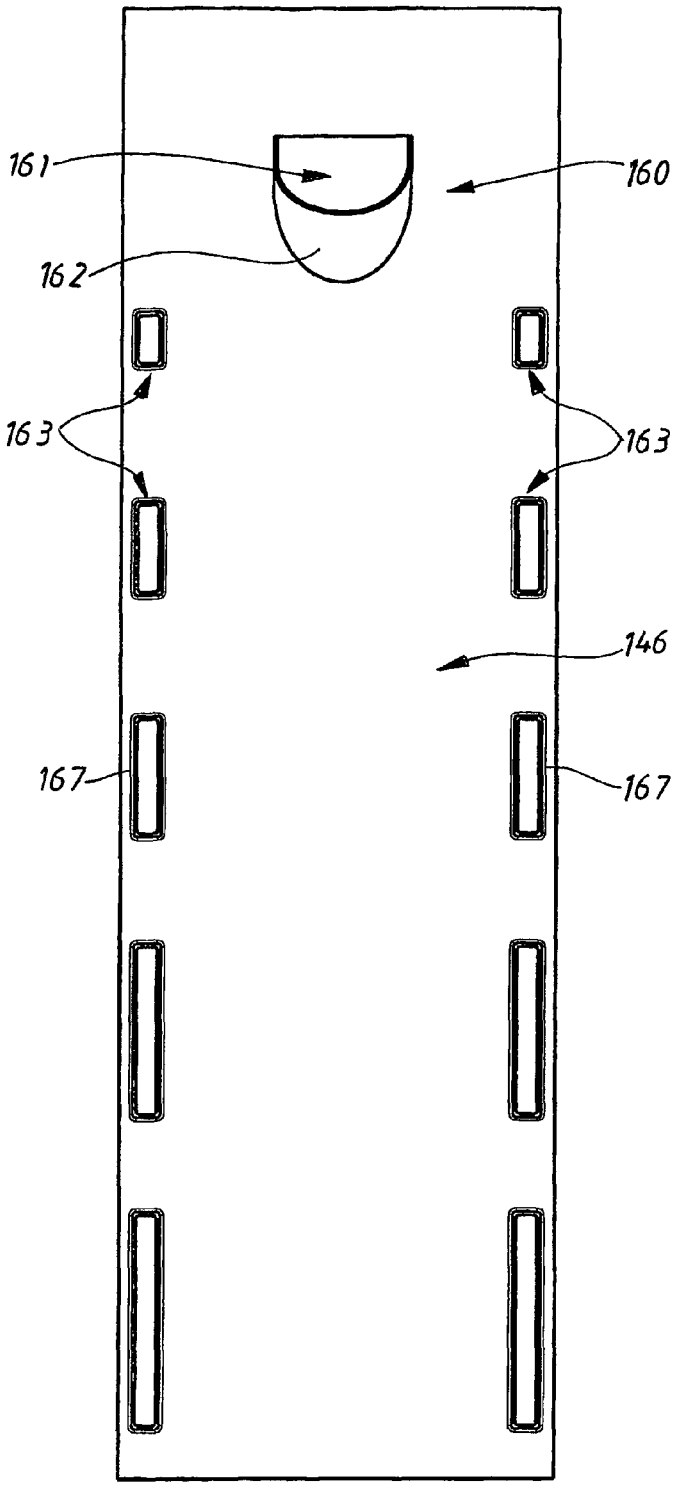
FIG. 25 shows a front view of the lid ducting part according to FIG. 24.
Figure 26:
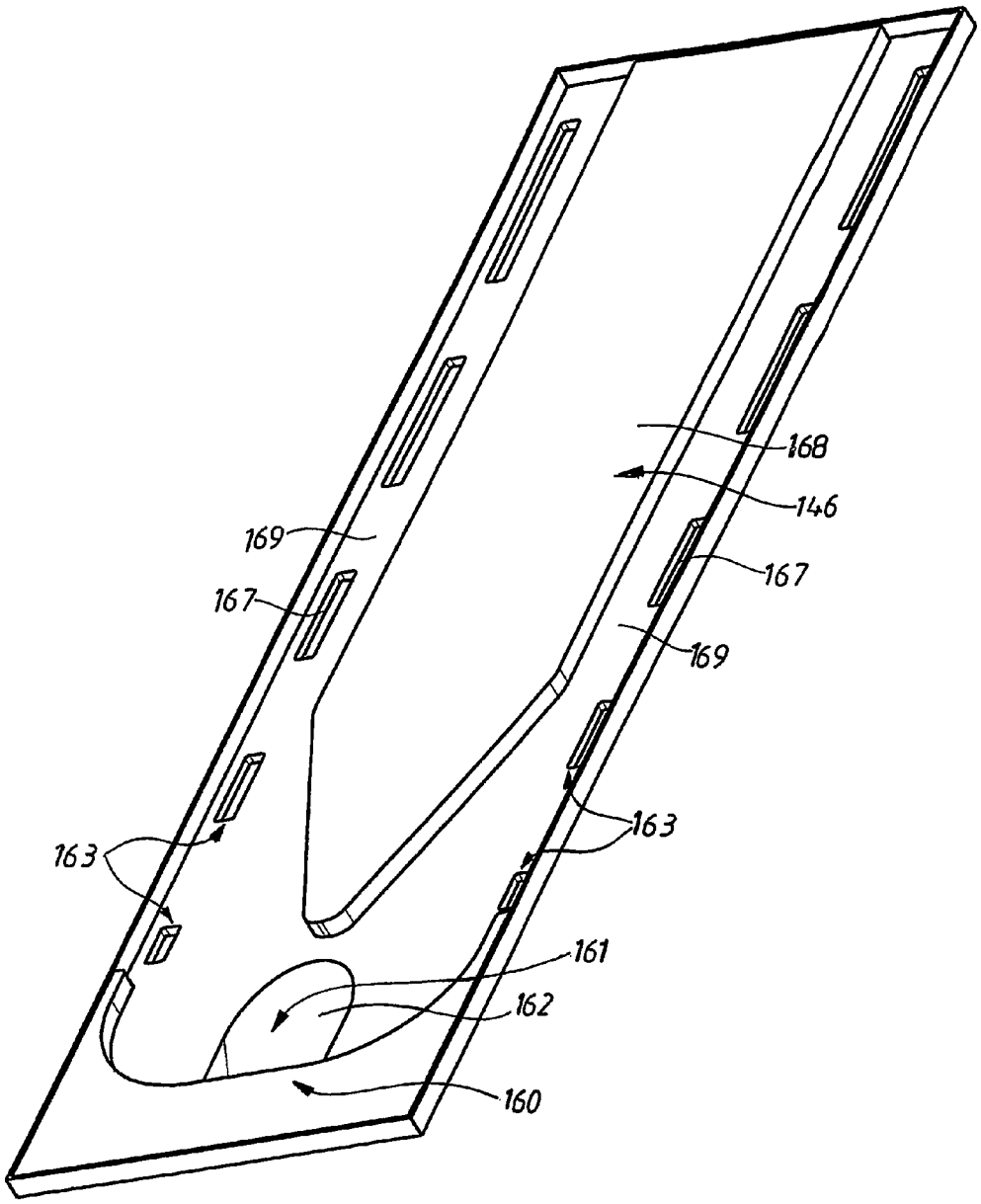
FIG. 26 shows a back perspective view of the lid ducting part according to FIG. 24.
Figure 27:
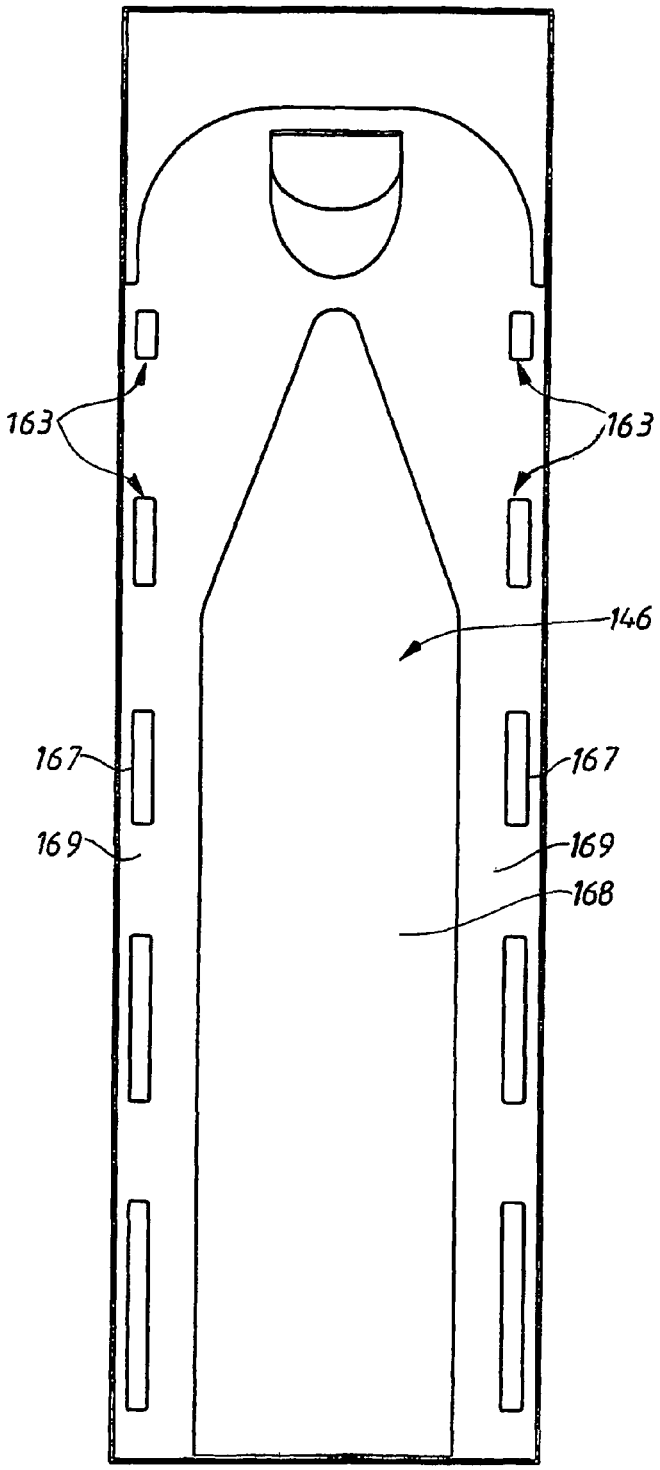
FIG. 27 shows a back view of the lid ducting part according to FIG. 24
Figure 28:
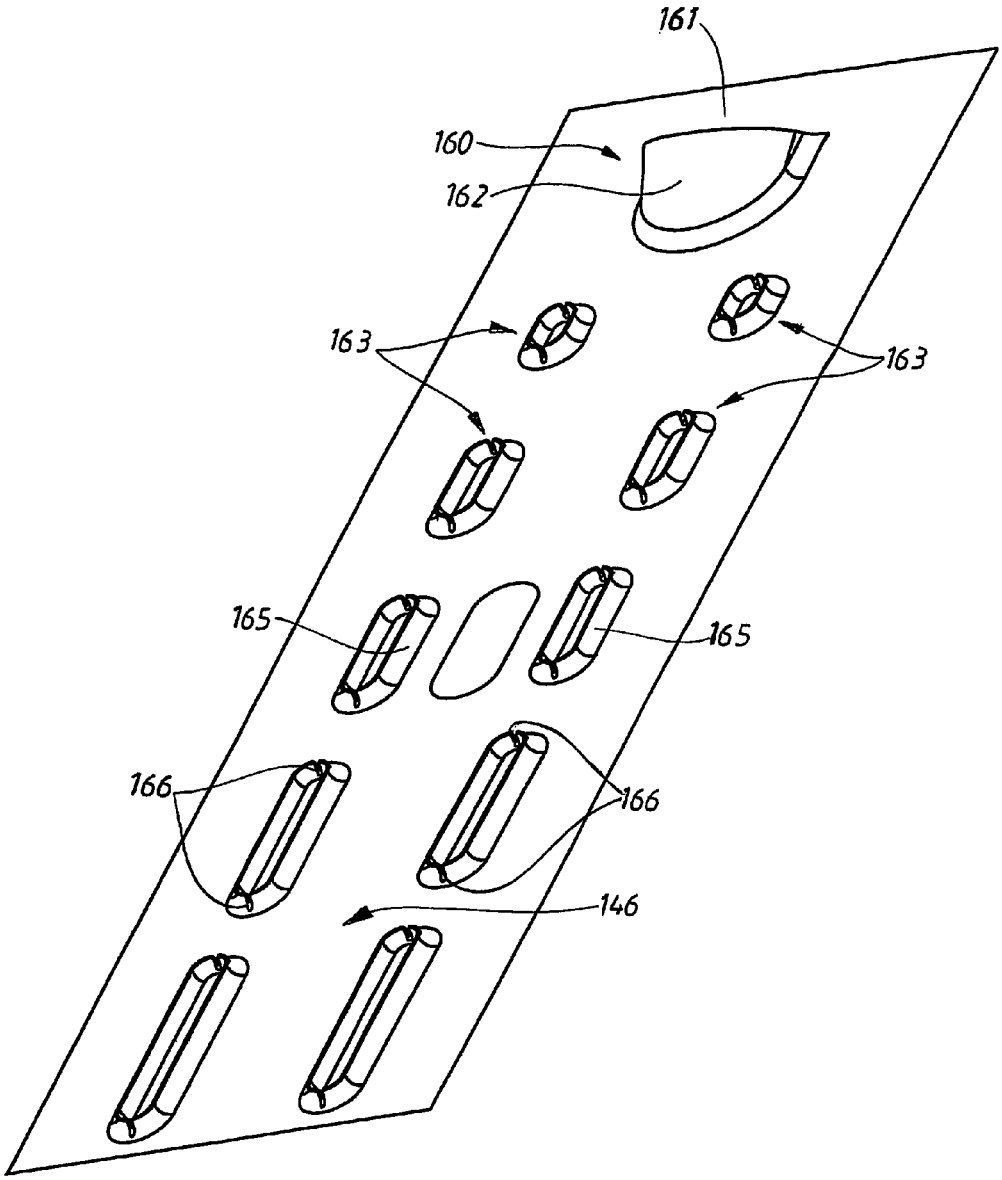
FIG. 28 shows a front perspective view of an alternative lid ducting part according to the present invention.

The first embodiment of the lid ducting part according to FIG. 24-27 in many aspects corresponds to the lid ducting part according to FIG. 28-31. The lid ducting part will therefore be described in relation to the corresponding views 24/25 and 28. In FIG. 24-25 and 28 the side of the lid facing the freezer compartment 117 is shown and a lid air directing part 160 is shown in those figures. Said part comprises a ducting opening 161 and a lid tube part 162. The leaning angles of the opening and the part are adapted to the angles of the airflow directing part 135 at the return ducting part 121. The reason is that the grill opening and ducting opening should cooperate so that the airflow from the grill opening may, when the lid is closed, flow in though the ducting opening. It is preferable to place a gasket on either of the openings so that the cooperation between those is as air tight as possible.

Both embodiments of the lid ducting part 146 contain airflow openings 163. These are spread out over the part in two distinctive rows. The size of the openings are more narrow in the area part nearest the lid air directing part 160, corresponding to the area nearest the refrigerated air supply system 121. Moreover, the size increases by distance away from the air directing part. The reason for that is that air flowing behind the lid ducting part will flow out through the openings and then openings most far from the air directing part will get less air because of their position. A larger opening size more far away enables for the same volume of air per time unit to pass through all the openings. This will then guarantee that air is spread more evenly into the freezer compartment 117. The characteristics of the airflow will be described further below. The openings are moreover divided into two rows in order to further achieve an even airflow through the whole compartment.

Figure 29:
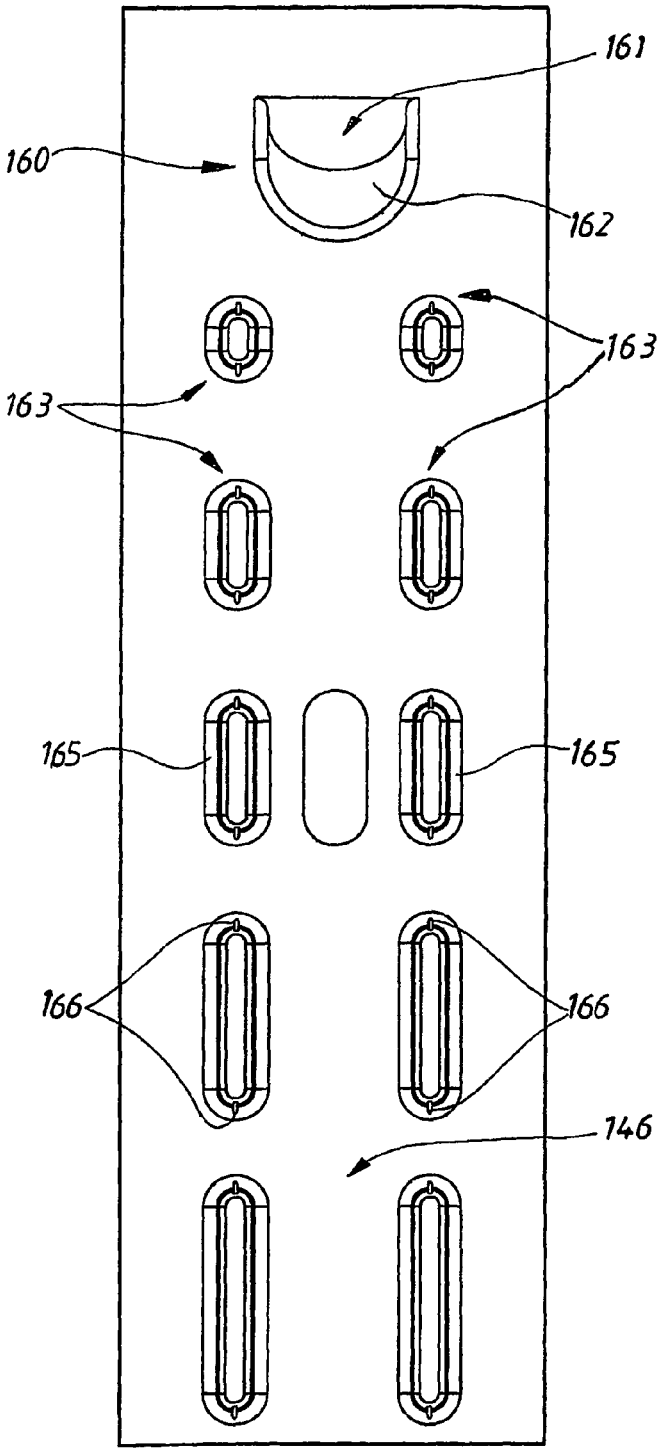
FIG. 29 shows a back view of the lid ducting part according to FIG. 28.
Figure 30:
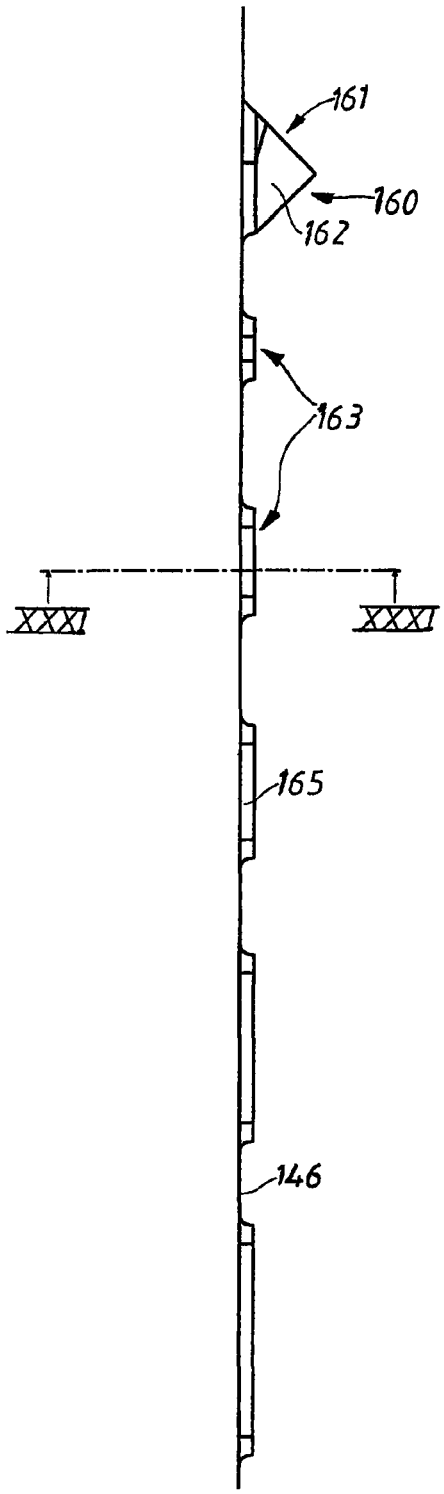
FIG. 30 shows a side view from the left side of the lid ducting part according to FIG. 30.
Figure 31:
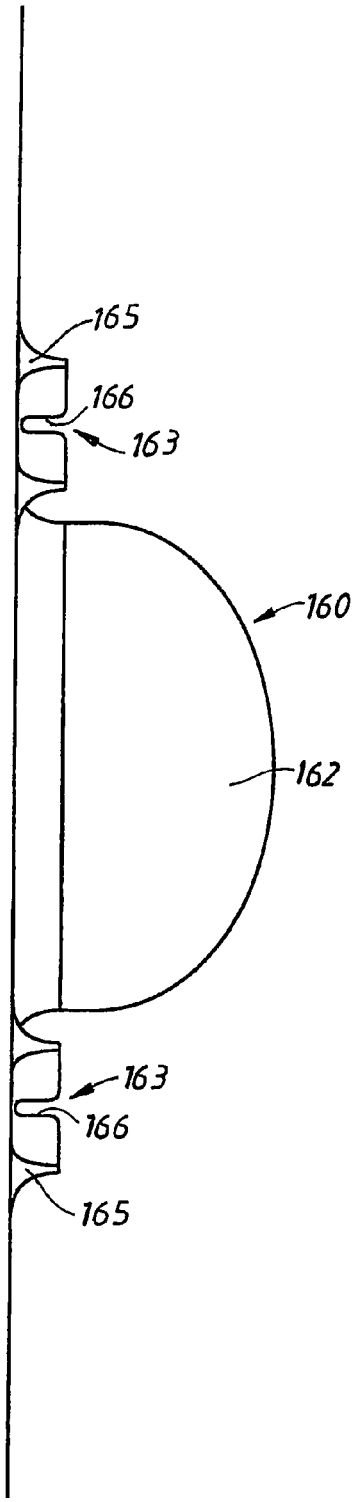
FIG. 31 shows a cross sectional view at A-A of the lid ducting part according to FIG. 30.

In FIG. 28-31 the airflow openings 163 have a different design in relation to the embodiment of FIG. 24-27. The openings are rounded and the outer sides 165 of the edges around all openings are sloping in order to improve the strength of the edges. Furthermore, all edges have a groove 166 at the two opposite shorter side of the openings. In FIG. 30 the lid ducting part of FIG. 28-31 is shown as a simplified side view with the lid air directing part 160 in the upper area. FIG. 31 shows a simplified cross sectional vies at A-A in FIG. 30 of the lid ducting part with the lid air directing part in the middle.

The reason for using grooves is to improve the air flowing capacity of the lid ducting part 146. If the freezer compartment 117 is totally filled with food products, these may block openings when the lid is closed. The air will then be able to pass out through the grooves, meaning that the operational conditions of the chest freezer will remain substantially unaffected. In FIG. 24-25 the openings are square-shaped and do not have these kinds of grooves. Therefore its outer edges 167 do not have to be as strong as in the other embodiment since there are no grooves weakening its strength.

FIG. 26-27 and FIG. 29 shows a back view and back perspective view of the lid ducting part 146. FIG. 26-27 correspond to the embodiment of FIG. 24-25 and FIG. 29 to the embodiment of FIG. 28 Moreover, at some parts FIG. 29 is simplified in relation to a proper design. This will be described in relation to the figure. The lid ducting part of FIG. 26-27 and 29 shows the airflow openings 163 from the backside with the edges 167 or correspondingly 165 marked. Moreover, the airflow directing part 160 with the ducting opening 161 and the lid tube part 162 are shown. FIG. 29 also shows the grooves 166. The illustration of the edges and the grooves in the simplified FIG. 29 shows how these could look from the backside. The actual design may differ from what is illustrated. FIG. 27 further shows a middle section 168 dividing the volume between the lid ducting part 146 and the inner wall side of the lid alternately the insulation into two ducts 169. This will cause the airflow from the airflow directing part to be divided substantially evenly between the two rows of airflow openings. The airflow will thereby be spread more evenly into the freezer compartment 117. The embodiment of FIG. 28-31 may also comprise this middle section The lid ducting part 146 will when mounted on the lid form a space between the part and the lid inner wall alternately the insulation. It is in this space that the airflow is guided from the air directing part 160 to the airflow openings 163. In the case of insulation it is important that there is a separating wall (not shown) that provided that keeps the insulation out from the space. Such a wall is needed depending on how the insulation is provided into the lid. Especially, if the insulation is pressured sprayed into the lid this wall is very important. A person skilled in the art realizes that any kind of separating wall falls within the scope of the invention.

The main task of the present is to provide a cooling system for a Chest freezer which enables a frost-free freezer compartment 117 and also improves the heat transfer between the refrigerated air supply system 121 and the foodstuff. Moreover, it is also important to provide a cooling system for a chest freezer which is easy to implement into an ordinary chest freezer compartment 117 for production. The present invention provides a solution to these problems.

Referring to FIG. 32 the operation of the chest freezer cabinet will now be described. The figure shows a cross section of the refrigerated air supply system 121 positioned inside the freezer compartment 117. The evaporator 126, the fan and motor 128 can be seen. Moreover, the inner walls 116 are shown together with the machine compartment walls 124, the outer walls 115 and the space 118 in which insulation is placed. The figure also shows the lower piece 131, the enclosing piece 134 and the airflow directing part 135. In the lowest part of the freezer compartment, the floor ducting part 122 is positioned resting on the compartment floor. The ribs 144 create ducts extending from the left to the right in the figure. The ducts connect the grill opening 141 with the lowest part of the lower piece. The lid ducting part 146 is also shown in the figure together with the airflow openings 163.

When operating the systems works as follows. A control system controls the operation of the refrigerated air supply system and the compressor in order to achieve a good freezer environment based on the settings made by the user. The system may also comprise means in order to detect the conditions of the food products and adapts its operation according to that. Every system uses sensors placed in freezer compartment and near the refrigerated air supply system in order to detect the conditions, such as the temperature and maybe also the moisture level. The refrigerated air supply system also comprises frost-free means in the form of a heating wire attached to the evaporator. The operation of the frost-free means is for instance based on information from an ice-collecting sensor on the evaporator, conditions sensed by the other sensors or by a time schedule.

When operating, the fan and motor part 128 will create an airflow 145 that is forced out through the grill opening 136 of the airflow directing part 135 into the lid airflow directing part 160 through the ducting opening 161. The air will then be divided into the two ducts 169 and out through the airflow openings 163. Since the openings have different size, the air volume flowing out of each opening will be more similar than if the openings had the same size. The dividing will also be substantially equal between the two ducts. Arrows 170 illustrates the air flowing out in the two ducts and the arrows 171 illustrate the air flowing out of each opening. Arrows 172 then shows how the airflow is spread out evenly in the freezer compartment 117.

If there are some of the earlier mentioned grooves on the inner walls 116 these will enable for the air to flow along the inner walls without any risk for blocking food products. Obviously, the airflow very much depends on how the food products are stored in the compartment. If there is a lot of airspace between them the airflow will be able to achieve a better reach and contact. On the other hand, if the user has been very ambitious storing as much as possible into the compartment, the airflow will be less even meaning that it will be less effective to reach and get in contact with the food products. In perfect conditions the airflow will reach all parts of the compartment and thereby be able to bring as much heat and moisture as possible out from the compartment.

The air is forced downwards in the freezer compartment 117 towards the outlet formed by the grill opening 141 at the floor ducting part. Since the grill opening 141 of the floor directing part is positioned in the opposite direction in relation to the grill opening 136 of the airflow directing part 135, the airflow will have to reach the more fare away area of the compartment. This is important in order to improve the airflow capacity. If there are some of the earlier mentioned grooves on the front side of the ducting part 122 there will not be any blocking risk of the airflow. The arrow 148 shows how the heated and moisturized airflow is flowing into the ducts formed underneath the ducting part. The airflow is then further guided to the right illustrated by the arrows 149. The air then flows upwards along the ducts formed between the lower part 131 and the inner walls 116 towards the evaporator 126, see arrows 175.

When reaching the evaporator 126 the airflow will pass through it. The heat will then be collected by the evaporator and moisture be condensed on the evaporator fins. The colder and dryer airflow will then flow out towards the fan and motor 128, see arrow 176. The airflow has thereby reached its original position. The fan and motor then again forces it out into the freezer compartment. The control system will operate the fan and motor and the compressor so that the evaporator removes the right amount of heat. The frost-free system will also melt and remove the frosted condense water collected, so that the refrigerator system keeps its efficiency.

The chest freezer may also be used without the floor ducting part 122. The distance between the lowest part 133 of the return ducting part and the freezer compartment floor will then form the opening into which the air from the grill opening 139 will flow. This will result in that the airflow will not reach the whole compartment as good as when the ducting part is used.

The illustrated system will solve the above-mentioned object. It should be understand be a person skilled in the art that other dynamic systems having the similar solution of the refrigerated air supply system also falls within the scope of the invention.

Figure 33:
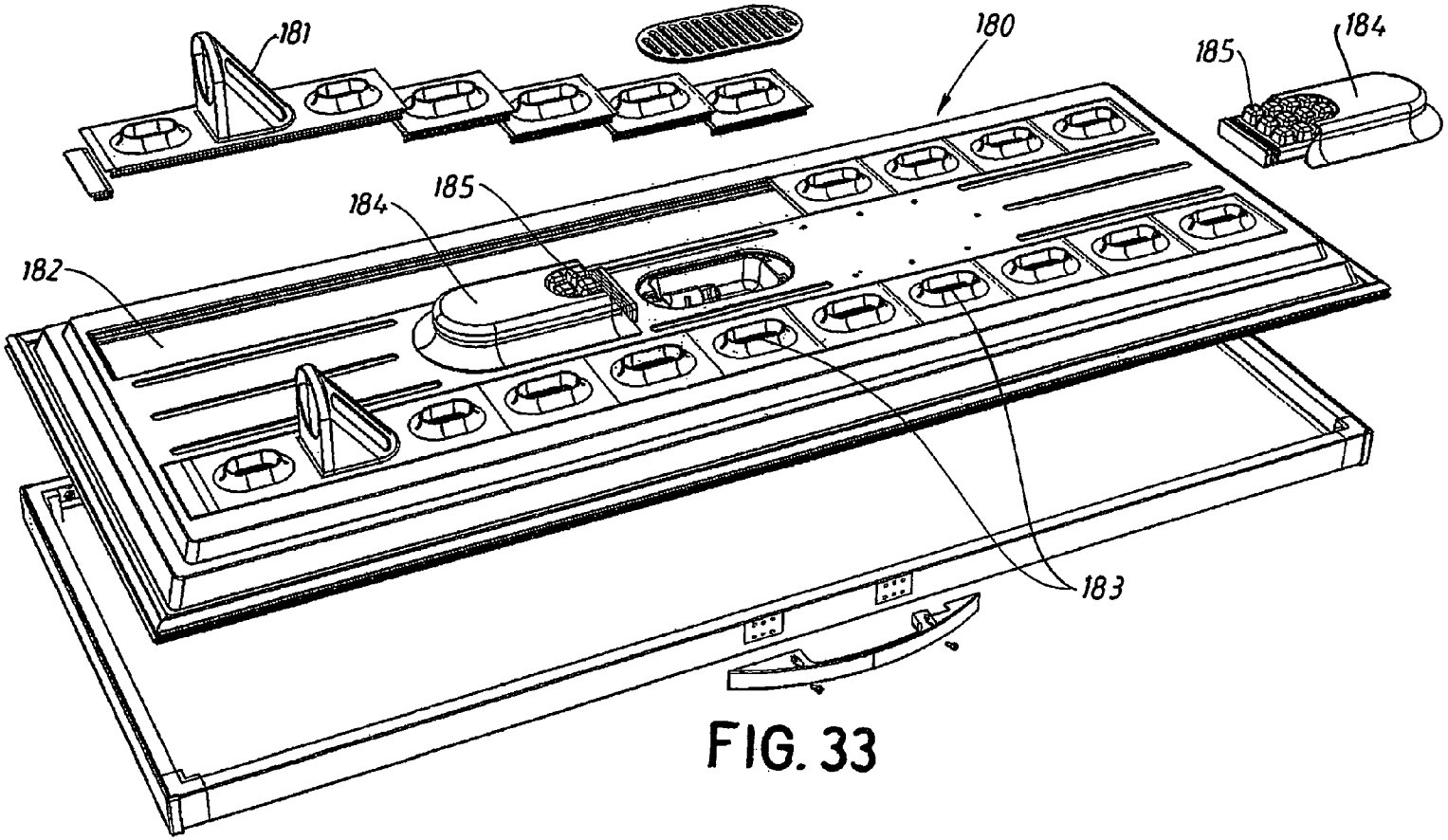
FIG. 33 shows a perspective view of a modified lid
Figure 34:
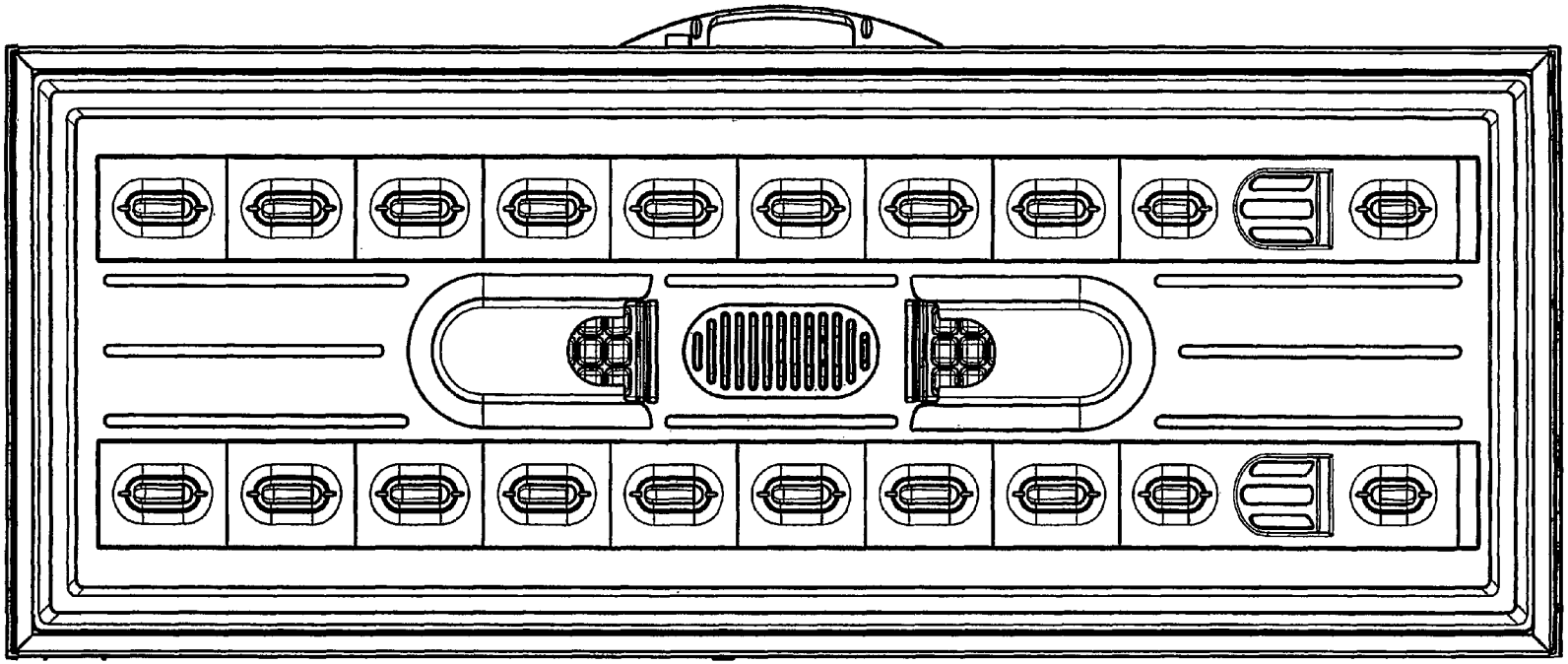
FIG. 34 shows a plan view of the lid shown in FIG. 33.
Figure 35:
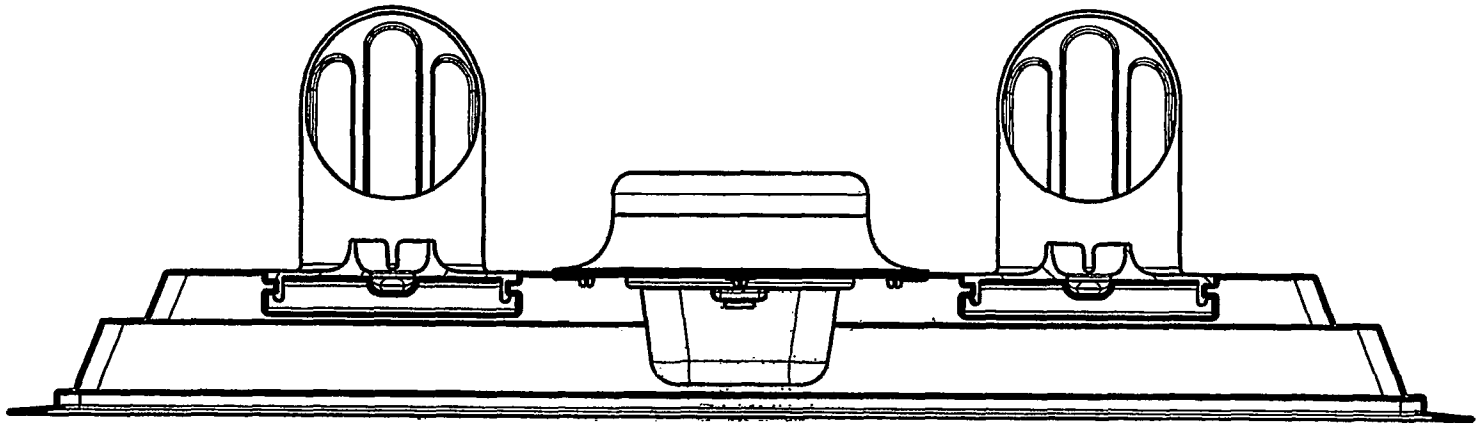
FIG. 35 shows a side view of the lid shown in FIG. 33
Figure 36:
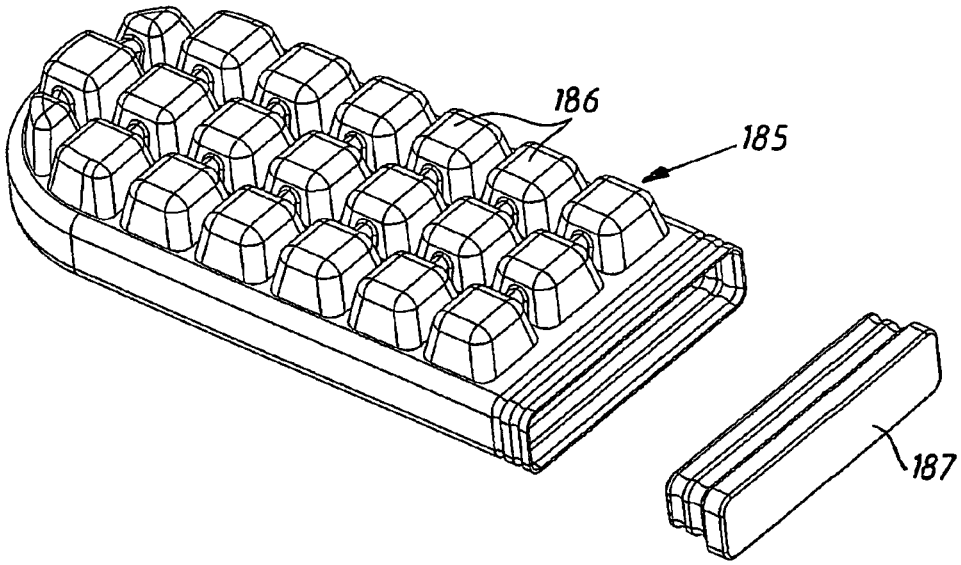
FIG. 36 shows a perspective view of an ice cube holder arranged at the lid.

The modified lid 180 according to FIG. 33-35 is provided with two air flow directing parts 181 each arranged to communicate with an elongated air duct 182 placed within the lid 180 and provided with several outlet openings 183 directing the air flow into the compartment. In this case there are two air flow directing parts arranged after the fan 128 as seen in the air flow direction each of these parts being in fluid communication with the air flow directing parts 181 arranged at the lid 180. The lid is also provided with two cup shaped holders 184 each having an open end in which an ice cube container 185 can be inserted. The container 185 is shaped as an open ended, blow molded, compartment having several projections 186 forming internal pockets for the ice cubes and being provided with a removable cover 187. When preparing ice cubes water is filled into the compartment such that the water level reaches the upper parts of the pockets and the container 185 is then secured to the lid by inserting it into the holder 184. When the water has frozen the ice cubes can be pressed out from the pockets into the compartment and then be taken out from the container. It is also possible to fill the container completely with water and use the container as a cooling element in a cooler bag when the water has frozen.

It will be appreciated by those ordinary people skilled in the art that the present invention can be embodied in other specific forms without departing from the spirit or essential character thereof. The present disclosed embodiment is therefore considered in all respect to be illustrative and not restrictive. The appended claims rather than the foregoing description indicate the scope of the invention, and all changes that come within the meaning and range of equivalents thereof are intended to be embraced therein.

The invention claimed is:

1. A chest freezer, comprising:

a cabinet (115), inner walls (116) defining a single cabinet compartment (117) having an opening that faces upwards, an insulation layer at least partly enclosing said cabinet compartment, a door (119) which in a horizontal position closes said opening, and a refrigerated air supply system (121) positioned inside said cabinet compartment, wherein the refrigerated air supply system (121) comprises:

a return ducting part (125) placed against a first inner wall and defining ducts to bring an airflow, an evaporator (126) positioned in the return ducting part for refrigerating the airflow, a fan (128) to circulate the airflow, a door ducting part (146, 180) to guide the airflow along the door from the return ducting part to the cabinet compartment, in a direction from the first inner wall to a second inner wall that is opposite to said first inner wall, and a floor ducting part (122) to guide the airflow along the floor of the cabinet compartment from the cabinet compartment back to the return ducting part (125), in the direction from the second inner wall to the first inner wall.

2. Chest freezer according to claim 1, wherein the floor ducting part (122) is placed horizontally on the floor and has an air inlet (141) to receive the airflow from the cabinet compartment, and it communicates with the return ducting part for guiding the airflow into the return ducting part.

3. Chest freezer according to claim 1, wherein the floor ducting part (122) comprises a plurality of parallel ducts for bringing the airflow.

4. Chest freezer according to claim 1, wherein the door ducting part (146, 180) has at least one airflow inlet (161, 181) to receive the airflow from the return ducting part (125), at least one airflow outlet (163, 183) to allow the airflow to flow downwards into the cabinet compartment, and at least one door ducting space (169, 182) creating an airflow connection between said at least one airflow inlet (161, 181) and said at least one outlet (163, 183).

5. Chest freezer according to claim 4 wherein said door ducting part (146) comprises separating means (168) dividing the airflow inside said door ducting space so that the airflow flows towards at least two separate airflow outlets (163) respectively.

6. Chest freezer according to claim 4, wherein the door ducting part (146, 180) comprises a plurality of airflow outlets (163) arranged in two distinct rows, the size of the openings increasing with the distance from the return ducting part (125).

7. Chest freezer according to claim 3, wherein a backside (43) of said floor ducting part (22) comprises separated ribs (44) to separate said parallel ducts from each other.

8. Chest freezer according to claim 1, wherein machine compartment walls (124) define a machine compartment (123) for storing at least one compressor, wherein one of the inner walls (116) forms a shelf plane (52) above the machine compartment (123) and wherein the return ducting part cooperates with the shape of said one of the inner walls (116).

9. Chest freezer according to claim 1, wherein the single cabinet compartment (117) is fully opened upward.

10. Chest freezer according to claim 9, wherein the chest freezer does not include another opening or door.

11. Chest freezer according to claim 1, wherein the floor ducting part (122) comprises a floor panel and separated ribs (44) that extend from the floor panel and define a plurality of parallel ducts for bringing the airflow.

12. Chest freezer according to claim 1, wherein the floor ducting part (122) comprises a front side facing upward and a backside facing a floor of the single cabinet compartment (117), wherein the front side comprises one or more grooves along its surface.

13. Chest freezer according to claim 4, wherein an outlet wall defining the at least one airflow outlet (163, 183) extends from a planar surface of the door ducting part (146, 180).

14. Chest freezer according to claim 13, wherein an edge of the outlet wall has a groove.

15. Chest freezer according to claim 14, wherein the outlet wall extends from the planar surface at a sloping angle.

16. Chest freezer according to claim 1, wherein the inner walls (116) comprise one or more grooves.

17. Chest freezer according to claim 1, wherein the door ducting part (146, 180) comprises a lid air directing part (160) and the return ducting part (125) comprises an airflow directing part 135 to guide the airflow into the lid air directing part (160) when the door closes said opening.

18. Chest freezer according to claim 17, wherein a sealing surface of the lid air directing part (160) abuts a sealing surface of the airflow directing part 135 when the door closes said opening.

* * * * *